US007677541B2

(12) United States Patent
Ahn

(10) Patent No.: US 7,677,541 B2
(45) Date of Patent: Mar. 16, 2010

(54) SPRING STRUCTURE FOR BED MATTRESS

(75) Inventor: Yoo Soo Ahn, Kyonggi-Do (KR)

(73) Assignee: Ace Bed Co., Ltd., Kyonggi-Do (KR)

( * ) Notice: Subject to any disclaimer, the term of this patent is extended or adjusted under 35 U.S.C. 154(b) by 828 days.

(21) Appl. No.: 11/445,109

(22) Filed: May 31, 2006

(65) Prior Publication Data

US 2007/0216076 A1 Sep. 20, 2007

(30) Foreign Application Priority Data

Mar. 14, 2006 (KR) ..... 10-2006-0023307

(51) Int. Cl.
*F16F 1/06* (2006.01)

(52) U.S. Cl. ..... 267/179; 267/88; 267/93; 267/75; 267/142

(58) Field of Classification Search ..... 267/85, 267/86, 88, 92, 83, 180, 107, 109, 75, 131, 267/142, 170, 171, 178, 179
See application file for complete search history.

(56) References Cited

U.S. PATENT DOCUMENTS 198,833 A * 1/1878 Barmore ..... 5/256
1,756,270 A * 4/1930 Whittenberger ..... 152/97
2,668,278 A * 2/1954 Avery ..... 439/384
3,533,114 A * 10/1970 Karpen ..... 267/93
4,371,152 A * 2/1983 Kitchen et al. ..... 267/103
4,555,097 A * 11/1985 Hiatt ..... 267/100
4,726,572 A * 2/1988 Flesher et al. ..... 267/91
4,817,924 A * 4/1989 Thoenen ..... 267/91
5,575,460 A * 11/1996 Knopfel ..... 267/91
5,713,088 A * 2/1998 Wagner et al. ..... 5/256
5,868,383 A * 2/1999 Codos ..... 267/80
6,256,820 B1 * 7/2001 Moser et al. ..... 5/655.8
7,178,187 B2 * 2/2007 Barman et al. ..... 5/716
7,404,223 B2 * 7/2008 Manuszak et al. ..... 5/716
2007/0235915 A1 * 10/2007 Ahn ..... 267/167

FOREIGN PATENT DOCUMENTS

JP 56083631 A * 7/1981

* cited by examiner

*Primary Examiner*—Xuan Lan Nguyen
(74) *Attorney, Agent, or Firm*—Edwards Angell Palmer & Dodge LLP; Kongsik Kim

(57) ABSTRACT

Disclosed herein is a spring structure for a bed mattress which comprises a body spring formed in a coil shape, upper and lower end springs wound and extending horizontally at upper and lower portions of the body spring, an exposure wire spring formed integrally with the upper end spring in such a fashion as to be disposed above the upper end spring, and a connection end portion for integrally connecting the upper end spring and the exposure wire spring to each other, wherein a first contact-preventing end 30 is formed at the connection end portion in such a fashion as to be bent inclinedly upwardly from a distal end of the upper end spring positioned outwardly from an uppermost winding of the body spring.

13 Claims, 27 Drawing Sheets

THE STATE WHERE FIRST CONTACT-PREVENTING END 30 DESCENDS WITHOUT TOUCHING THE UPPERMOST WINDING 12

THE STATE WHERE FIRST CONTACT-PREVENTING END 30 DESCENDS WITHOUT TOUCHING THE UPPERMOST WINDING 12

THE STATE WHERE FIRST CONTACT-PREVENTING END 30 DESCENDS TOWARD CONTACT-PREVENTING SPACE BEHIND SECOND CONTACT-PREVENING END 32 WITHOUT TOUCHING THE UPPERMOST WINDING 12

THE STATE WHERE FIRST CONTACT-PREVENTING END 30 DESCENDS TOWARD CONTACT-PREVENTING SPACE BEHIND SECOND CONTACT-PREVENING END 32 WITHOUT TOUCHING THE UPPERMOST WINDING 12

SPRING STRUCTURE FOR BED MATTRESS

BACKGROUND OF THE INVENTION

1. Field of the Invention

The present invention relates to a spring structure for a bed mattress, and more particularly to such a spring structure for a bed mattress in which the structure of a connection end portion for connecting a body spring and an exposure wire spring to each other is improved such that the connection end portion is not in close contact with an uppermost winding of the body spring, thereby easily preventing a deformation of the spring due to a frictional contact, preventing a contact noise, and further enhancing the resilient strength of the spring to prolong the lifespan of the spring.

2. Background of the Related Art

In general, a bed mattress is mounted on a bed frame and is used as means adapted to provide a cushion force and buffering force. The bed mattress basically includes a spring assembly, an intermediate member laminatedly attached on the upper and lower surfaces of the spring assembly, an edge former fittingly attached to the circumferential edge of the spring assembly, and a cover member for protecting the surfaces of the intermediate member and the edge former.

Especially, the spring assembly is composed of springs vertically arranged spaced apart from one another at regular intervals over the entire area of the bed mattress, and a helical coil for securely engaging the springs with one another.

Herein, in order to better understand the present invention, a process for manufacturing a bed mattress will be hereinafter described in brief with reference to FIG. 13.

Referring to FIG. 13, the process for manufacturing the bed mattress includes the following steps of: fabricating a spring assembly 2 including coil springs arranged along row and column directions over the entire area of the bed mattress in such a fashion as to be spaced apart from one another at regular intervals, the coil springs being securely fixed by means of a helical coil; fittingly attaching an edge former as a support means to the circumferential edge of the spring assembly, and then continuously laminating multi-layered cushion means including a felt and a non-woven fabric as an intermediate member 4 on the upper and lower surfaces of the spring assembly 2; and covering the upper and lower surfaces and the circumferential edge surface of the intermediate member 4 as well as the outer surface of the edge former 3 with a cover 5, and then hermetically sealing a seam portion of the cover 5 with a sealing means 6.

Therefore, when a user sleeps or takes a rest, a load exerted to the bed mattress is absorbed and buffered by means of a cushion force of the intermediate member and a buffering force of the spring so that he or she can feel convenience and comfort.

Now, a spring structure for a conventional bed mattress constituting the spring assembly will be described hereinafter with reference to FIGS. 10*a* and 10*b*.

FIGS. 10*a* and 10*b* illustrate an example of a conventional spring structure.

Referring to FIGS. 10*a* and 10*b*, a conventional spring 600 includes a body spring 10 formed in a coil shape whose diameter is gradually increased as it goes toward the top and the bottom from the central portion thereof, an upper end spring 16 wound and extending horizontally at a terminating point of the uppermost winding 12 of the body spring 10, and a lower end spring 18 wound and extending horizontally at a terminating point of the lowermost winding 14 of the body spring 10.

In this case, a distal end of the upper end spring 16 is fixed in such a fashion as to be twisted at the terminating point of the uppermost winding 12 of the body spring 10, and a distal end of the lower end spring 18 is fixed in such a fashion as to be twisted at the terminating point of the lowermost winding 14 of the body spring 10.

However, when the bed mattress is manufactured by employing the conventional spring, there are the following demerits:

A large or small load applied to the bed mattress is finally buffered and absorbed by the spring.

In this manner, when different loads are irregularly concentrated on the spring, there is a risk that the deformation of the spring may be progressed rapidly. In addition, adjacent springs come into close contact with each other according to the deformation of the spring to thereby contribute to the generation of a noise.

In view of these problems, another type of spring (which has a dual buffer structure to decentrally buffer the larger and smaller loads separately) has been manufactured, and its shape is shown in FIGS. 11*a* to 11*c*.

Referring to FIGS. 11*a* to 11*c*, a conventional spring 700 of another type includes a body spring 10 formed in a coil shape whose diameter is gradually increased as it goes toward the top and the bottom from the central portion thereof, an upper end spring 16 wound and extending horizontally at a terminating point of the uppermost winding 12 of the body spring 10, and a lower end spring 18 wound and extending horizontally at a terminating point of the lowermost winding 14 of the body spring 10. The spring 700 is characterized in that a separate exposure wire spring 20 is formed integrally with the upper end spring 16 in such a fashion as to be disposed above the upper end spring 16.

At this time, a distal end of the upper end spring 16 is connected integrally with the exposure wire spring 20, and a distal end of the lower end spring 18 is fixed in such a fashion as to be twisted at the terminating point of the uppermost winding 14 of the body spring 10.

The exposure wire spring 20 has a diameter smaller than that of the body spring 10 and is configured to be wound in a coil shape. The exposure wire spring 20 also has a resilient force causing compressible deformation thereof relatively easily as compared to the body spring 10.

Especially, since a portion 24 (hereinafter, referred to as "connection end portion") extending from the distal end of the upper end spring 16 to the exposure wire spring 20 runs spirally toward a vertical central axis of the overall spring, the connection end portion 24 and the uppermost wiring 12 for the body spring 10 positioned just below the connection end portion intersect each other when viewed from the top.

Accordingly, in the case where a smaller load (just a load applied to the bed mattress when a user twists and turns in his or her bed mattress) is exerted to the bed mattress, the exposure wire spring 20 buffers/absorbs the load impact. On the other hand, in the case where a larger load (a load applied to the bed mattress when the user sits on the bed mattress) is exerted to the bed mattress, the body spring 10 buffers/absorbs the load impact.

As such, the body spring and the exposure wire spring perform a buffering function thereof separately depending on the magnitude of the load exerted to the bed mattress to thereby provide advantages of preventing the deformation of the spring and prolonging the lifespan of the spring.

But, the conventional spring of another type has the following demerits:

As shown in FIG. 12, when the exposure wire spring 20 is compressed along with the exertion of a load to the bed mattress, and simultaneously the connection end portion 24 for connecting the distal end of the upper end spring 16 and the exposure wire spring 20 to each other is applied with a compression load, the connection end portion 24 and the uppermost wiring 12 for the body spring 10 positioned just below the connection end portion intersect each other when viewed from the top as described above. Thus, the connection end portion 24 comes into close contact with the uppermost wiring 12 while descending, to thereby generate the noise due to the contact therebetween.

Moreover, in the case where a larger load is exerted to the bed mattress, the exposure wire spring 20 is compressed and simultaneously the body spring 10 is also compressed, so that the connection end portion 24 also descends upon the compression of the exposure wire spring 20. At this time, the connection end portion 24 comes into close contact with the uppermost winding 12 of the body spring 10 with a larger impact, to thereby generate a larger contact noise.

As such, the contact noise caused by the spring during the use of the bed mattress acts as a great stress to a user, which may become a critical disadvantage for bed mattress products.

In addition, if the connection end portion repeatedly comes into close with the uppermost winding of the body spring by friction, it will not be long before the spring itself is deformed.

SUMMARY OF THE INVENTION

Accordingly, the present invention has been made in view of the aforementioned problems occurring in the prior art, and it is an object of the present invention to provide a spring structure for a bed mattress in which the structure of a connection end portion for connecting a body spring and an exposure wire spring to each other is improved such that the connection end portion is not in close contact with an uppermost winding of the body spring, so that when the exposure wire spring is compressed by means of a load exerted to the bed mattress, the connection end portion does not bring into contact with the uppermost winding of the body spring, thereby easily preventing a deformation of the spring due to a frictional contact, preventing a contact noise, and further enhancing the resilient strength of the spring to significantly prolong the lifespan of the spring.

To accomplish the above object, according to one aspect of the present invention, there is provided a spring structure for a bed mattress which comprises: a body spring formed in a coil shape; upper and lower end springs wound and extending horizontally at upper and lower portions of the body spring; a first exposure wire spring formed integrally with the upper end spring in such a fashion as to be disposed above the upper end spring; and a first connection end portion for integrally connecting the upper end spring and the first exposure wire spring to each other. This spring structure further includes a first contact-preventing end. The first contact-preventing end is formed at the first connection end portion in such a fashion as to be bent upwardly or inclinedly upwardly from a distal end of the upper end spring positioned outwardly from the uppermost winding of the body spring so that the first exposure wire spring may not be in contact with the uppermost winding of the body spring and with the upper end spring.

According to another aspect of the present invention, there is provided a spring structure for a bed mattress which comprises: a body spring formed in a coil shape; upper and lower end springs wound and extending horizontally at upper and lower portions of the body spring; a first exposure wire spring formed integrally with the upper end spring in such a fashion as to be disposed above the upper end spring; and a first connection end portion for integrally connecting the upper end spring and the first exposure wire spring to each other. This spring structure further includes a first contact-preventing end and a second contact-preventing end. The first contact-preventing end is formed at the first connection end portion in such a fashion as to be bent upwardly or inclinedly upwardly from a distal end of the upper end spring positioned outwardly from the uppermost winding of the body spring so that the first exposure wire spring may not be in contact with the uppermost winding of the body spring and with the upper end spring. The second contact-preventing end is formed at the uppermost winding of the body spring positioned below the first contact-preventing end in such a fashion as to be bent upwardly or inclinedly upwardly from a terminating point of the uppermost winding of the body spring to a starting point of the upper end spring.

According to another aspect of the present invention, there is provided a spring structure for a bed mattress which comprises: a body spring formed in a coil shape; upper and lower end springs wound and extending horizontally at upper and lower portions of the body spring; a first exposure wire spring formed integrally with the upper end spring in such a fashion as to be disposed above the upper end spring; a first connection end portion for integrally connecting the upper end spring and the first exposure wire spring to each other; a second exposure wire spring formed integrally with the lower end spring in such a fashion as to be disposed below the lower end spring; and a second connection end portion for integrally connecting the lower end spring and the second exposure wire spring to each other. This spring structure further includes a first contact-preventing end and a third contact-preventing end. The first contact-preventing end is formed at the first connection end portion in such a fashion as to be bent upwardly or inclinedly upwardly from a distal end of the upper end spring positioned outwardly from an uppermost winding of the body spring so that the first exposure wire spring may not be in contact with the uppermost winding of the body spring and with the upper end spring. The third contact-preventing end is formed at the second connection end portion in such a fashion as to be bent downwardly or inclinedly downwardly from a distal end of the lower end spring positioned outwardly from a lowermost winding of the body spring.

According to another aspect of the present invention, there is provided a spring structure for a bed mattress which comprises: a body spring formed in a coil shape; upper and lower end springs wound and extending horizontally at upper and lower portions of the body spring; a first exposure wire spring formed integrally with the upper end spring in such a fashion as to be disposed above the upper end spring; a first connection end portion for integrally connecting the upper end spring and the first exposure wire spring to each other; a second exposure wire spring formed integrally with the lower end spring in such a fashion as to be disposed below the lower end spring; and a second connection end portion for integrally connecting the lower end spring and the second exposure wire spring to each other. This spring structure further includes a first contact-preventing end, a second contact-preventing end, a third contact-preventing end, and a fourth contact-preventing end. The first contact-preventing end is formed at the first connection end portion in such a fashion as to be bent upwardly or inclinedly upwardly from a distal end of the upper end spring positioned outwardly from an uppermost winding of the body spring, so that the first exposure wire spring may not be in contact with the uppermost winding of the body spring and with the upper end spring. The second contact-preventing end is formed at the uppermost winding of the body spring positioned below the first contact-preventing end in such a fashion as to be bent upwardly or inclinedly upwardly from a terminating point of the uppermost winding of the body spring to a starting point of the upper end spring. The third contact-preventing end is formed at the second connection end portion in such a fashion as to be bent downwardly or inclinedly downwardly from a distal end of the lower end spring positioned outwardly from a lowermost winding of the body spring. The fourth contact-preventing end is formed at the lowermost winding of the body spring positioned above the second contact-preventing end in such a fashion as to be bent downwardly or inclinedly downwardly from a terminating point of the lowermost winding of the body spring to a starting point of the lower end spring.

According to another aspect of the present invention, there is provided a spring structure for a bed mattress which comprises: a body spring formed in a coil shape; upper and lower end springs wound and extending horizontally at upper and lower portions of the body spring; a first exposure wire spring formed integrally with the upper end spring in such a fashion as to be disposed above the upper end spring; and a first connection end portion for integrally connecting the upper end spring and the first exposure wire spring to each other. This spring structure further includes a first contact-preventing end, a second contact-preventing end, and a fourth contact-preventing end. The first contact-preventing end is formed at the first connection end portion in such a fashion as to be bent upwardly or inclinedly upwardly from a distal end of the upper end spring positioned outwardly from an uppermost winding of the body spring so that the first exposure wire spring may not be in contact with the uppermost winding of the body spring and with the upper end spring. The second contact-preventing end is formed at the uppermost winding of the body spring positioned below the first contact-preventing end in such a fashion as to be bent upwardly or inclinedly upwardly from a terminating point of the uppermost winding of the body spring to a starting point of the upper end spring. The fourth contact-preventing end is formed at a lowermost winding of the body spring in such a fashion as to be bent downwardly or inclinedly downwardly from a terminating point of the lowermost winding of the body spring to a starting point of the lower end spring.

Preferably, each of the first, second, third, and fourth contact-preventing ends may have a height of 5 to 40 mm.

Also preferably, the inclination angle of the first, second, third, and fourth contact-preventing ends with respect to a vertical axis of the body spring is not greater than 60°.

BRIEF DESCRIPTION OF THE DRAWINGS

The above and other objects, features and advantages of the present invention will be apparent from the following detailed description of the preferred embodiments of the invention in conjunction with the accompanying drawings, in which:

FIGS. 9*a* and 9*b* are perspective views illustrating a spring structure for a bed mattress according to a fifth embodiment of the present invention, in which an exposure wire spring is connected to an upper end spring thereof, wherein FIG. 9*a* shows a state where the exposure wire spring is formed at an upper portion thereof and FIG. 9*b* shows a state where the exposure wire spring is formed at upper and lower portions thereof;

DETAILED DESCRIPTION OF THE PREFERRED EMBODIMENT

Reference will now be made in detail to the preferred embodiment of the present invention with reference to the attached drawings.

Figure 1A:
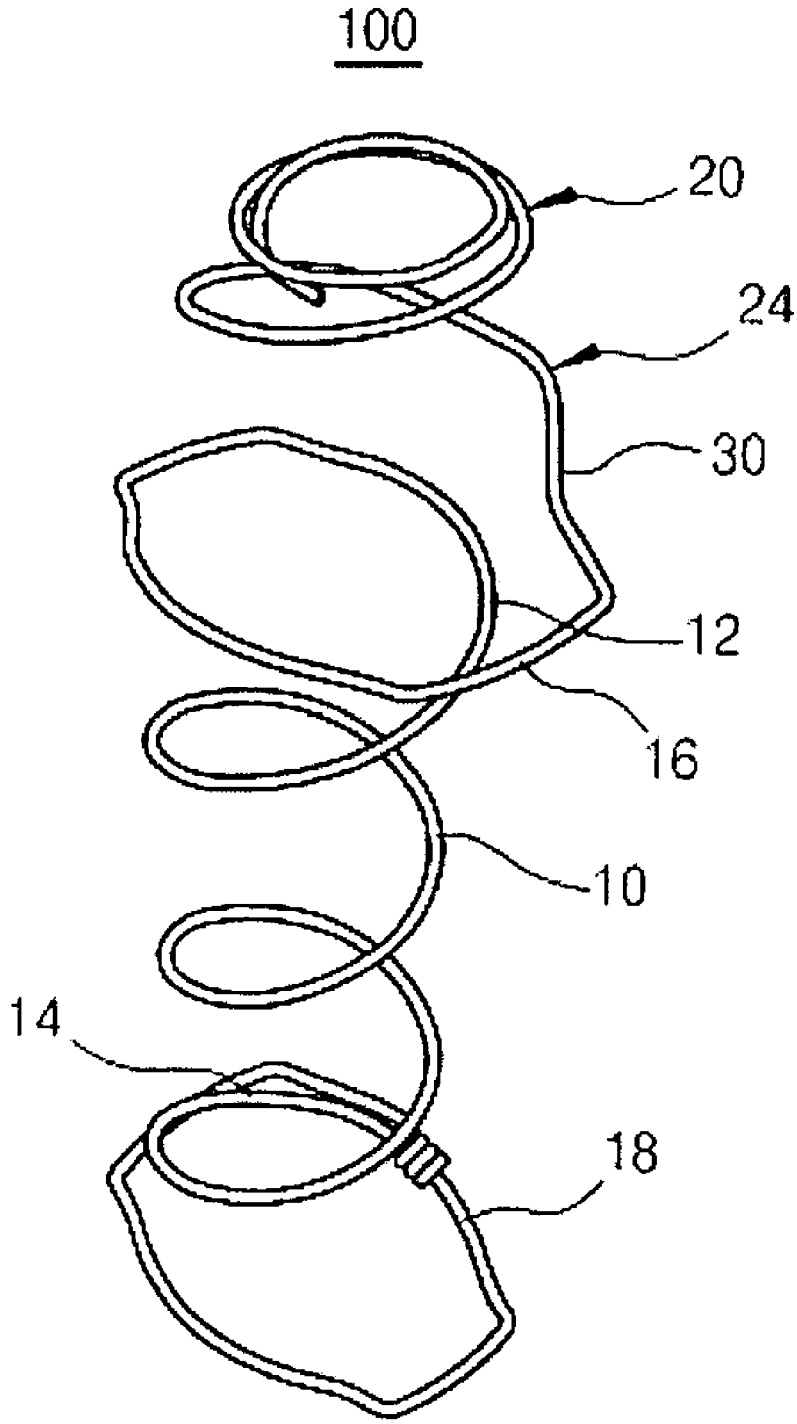
FIGS. 1*a*, 1*b* and 1*c* are a perspective view, a front view, and a side view illustrating a spring structure for a bed mattress according to a first embodiment of the present invention.
Figure 1B:
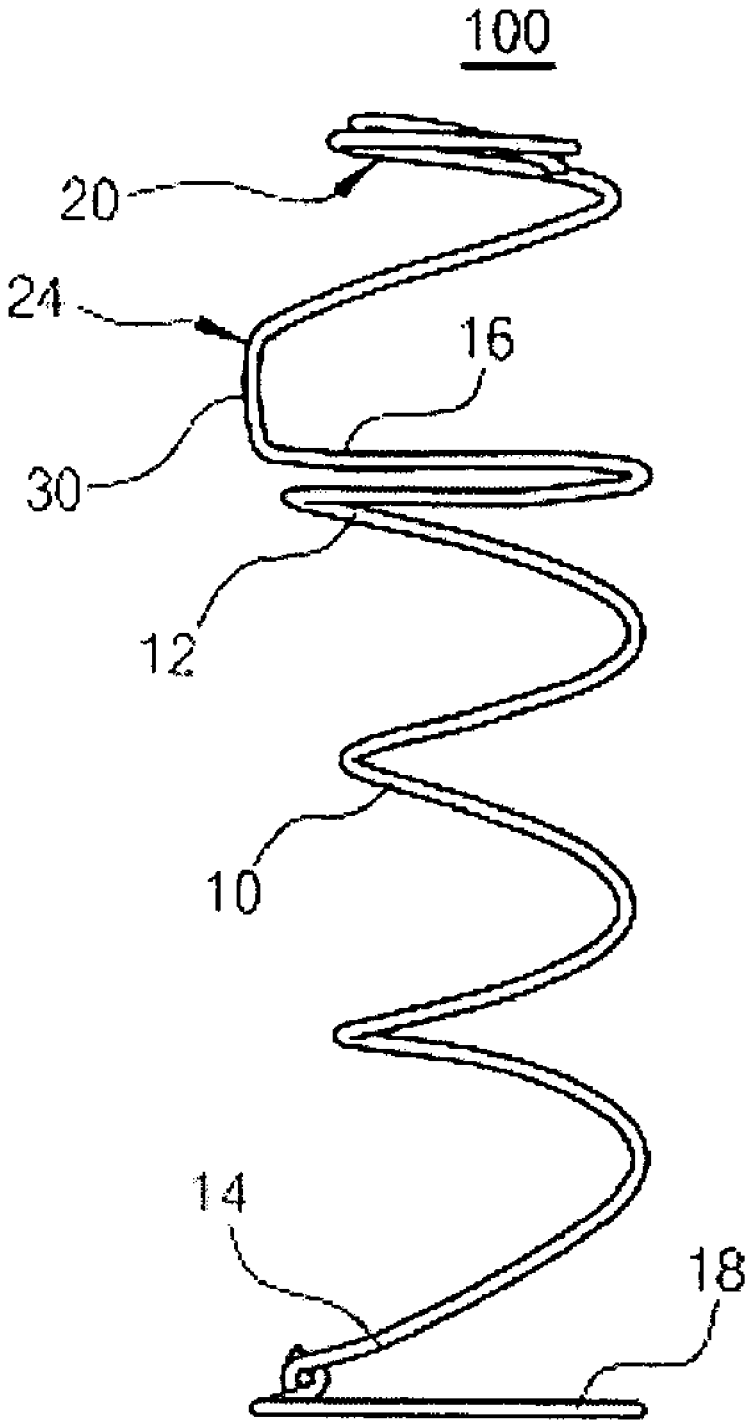
Figure 1C:
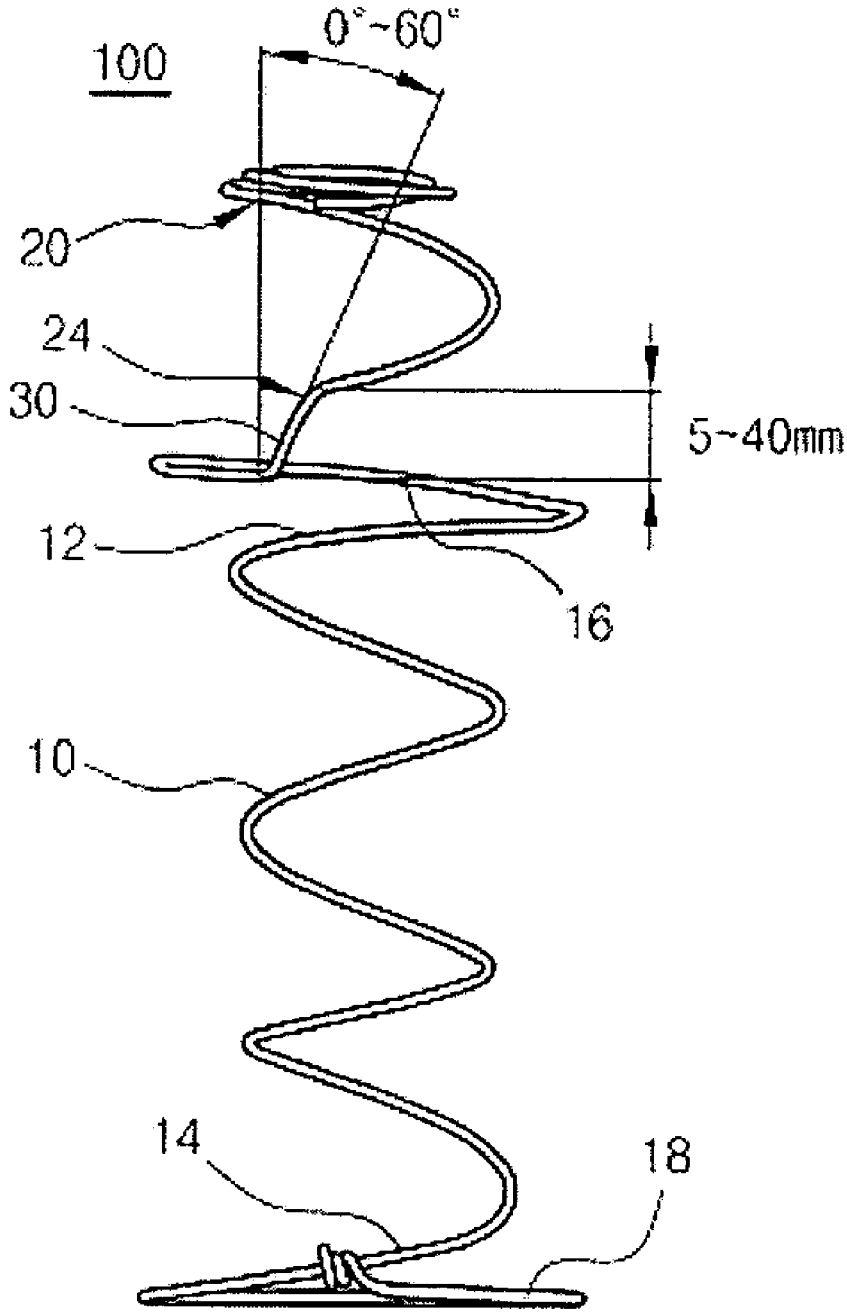
Figure 2A:
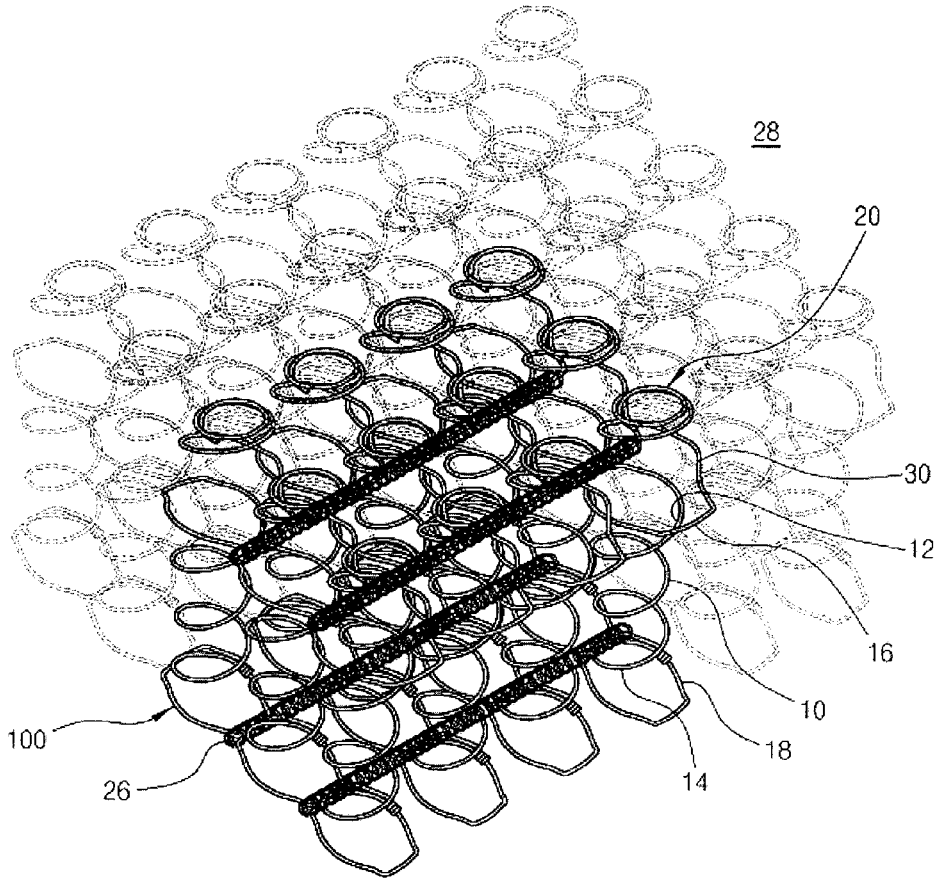
FIGS. 2*a*, 2*b* and 2*c* are a perspective view, a front view, and a side view illustrating the states where the spring structure according to the first embodiment of the present invention is assembled in a spring assembly.
Figure 2B:
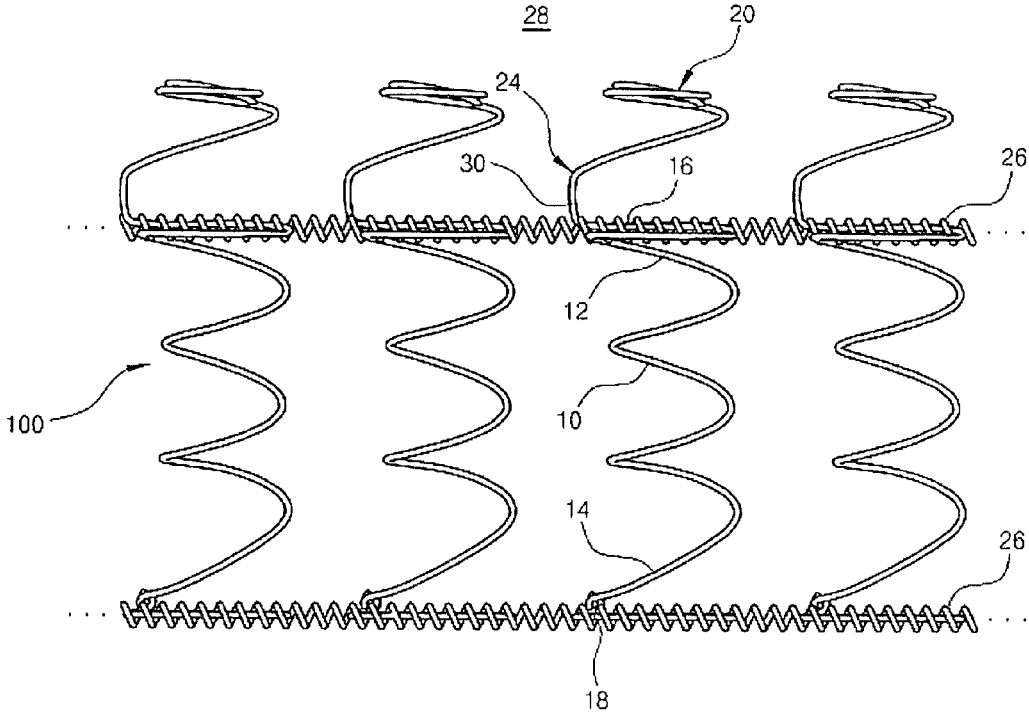
Figure 2C:
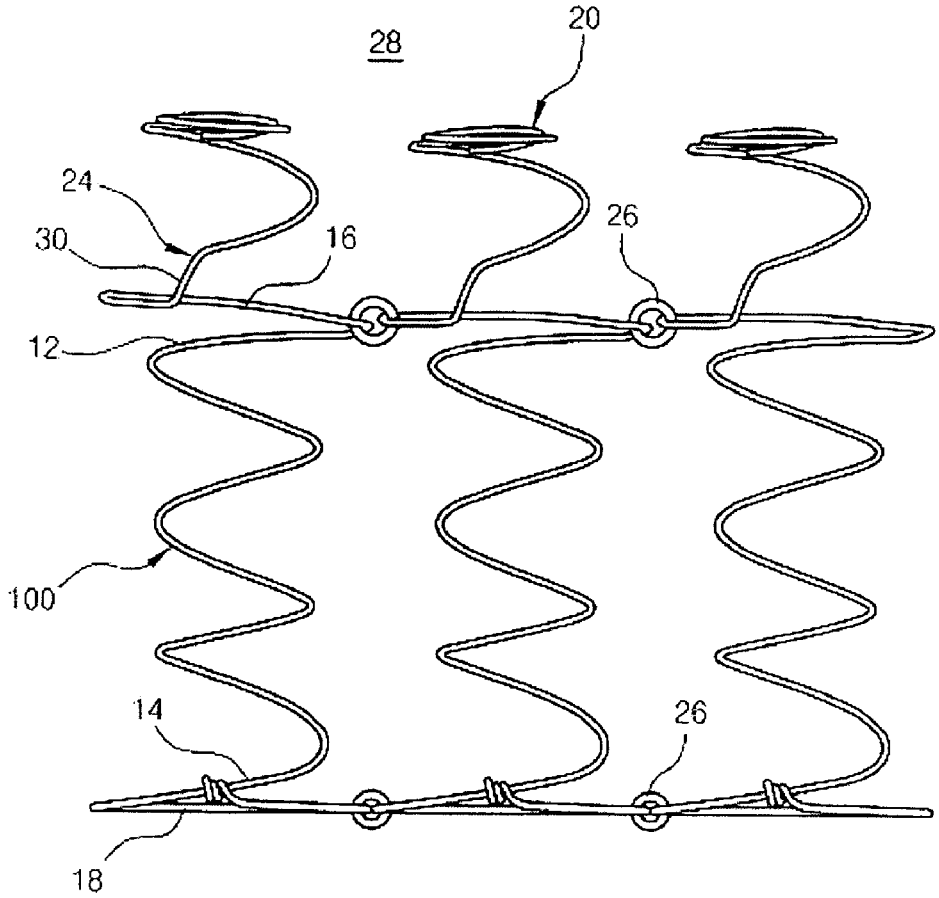
Figure 3A:
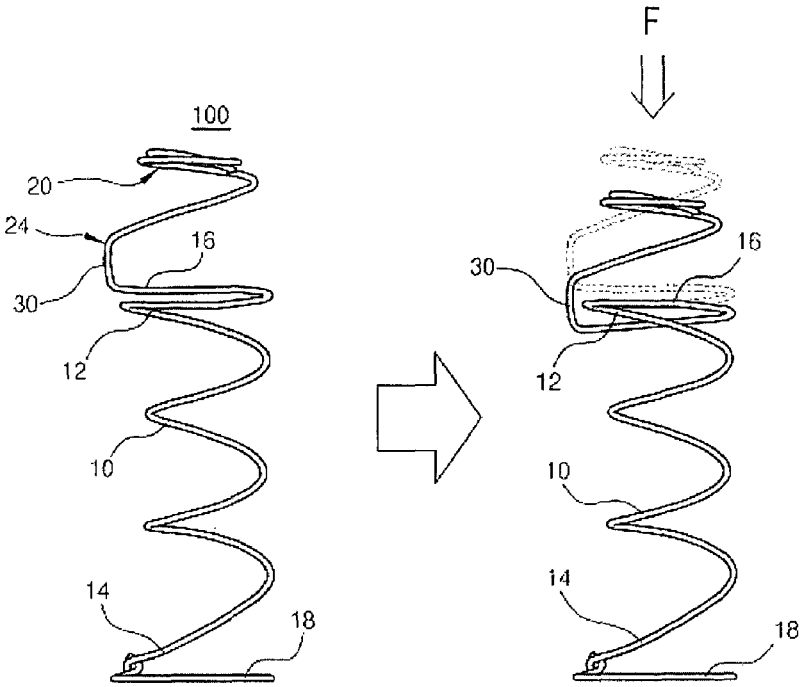
FIGS. 3*a* and 3*b* are a front view and a side view illustrating the compression actions of the spring structure according to the first embodiment of the present invention.
Figure 3B:
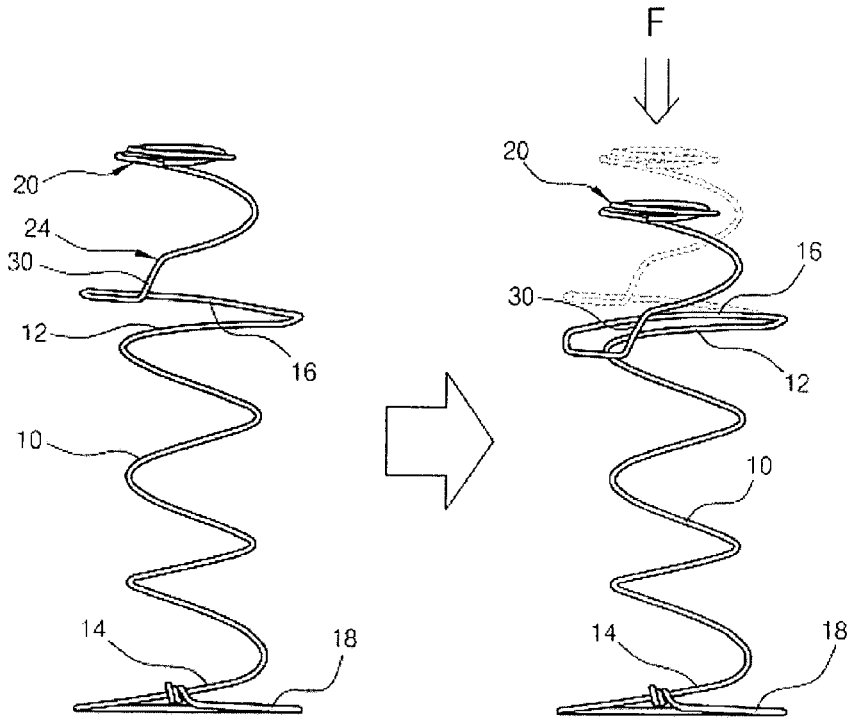

FIGS. 1*a*, 1*b* and 1*c* are a perspective view, a front view, and a side view illustrating a spring structure 100 for a bed mattress according to a first embodiment of the present invention, FIGS. 2*a*, 2*b* and 2*c* are a perspective view, a front view, and a side view illustrating the states where the spring structure 100 according to the first embodiment of the present invention is assembled in a spring assembly, and FIGS. 3*a* and 3*b* are a front view and a side view illustrating the compression actions of the spring structure 100 according to the first embodiment of the present invention.

Referring to the drawings, a spring structure for a bed mattress, which can perform a buffering function depending on the magnitude of a load exerted to the bed mattress, comprises a body spring 10 formed in a coil shape, upper and lower end springs 16 and 18 wound and extending horizontally at upper and lower portions of the body spring, an exposure wire spring 20 formed integrally with the upper end spring 16 in such a fashion as to be disposed above the upper end spring 16, and a connection end portion 24 for integrally connecting the upper end spring and the exposure wire spring to each other.

Especially, the exposure wire spring 20 has a diameter smaller than that of the body spring 10 in such a fashion that the diameter thereof is smaller as it goes toward the top and is configured to be wound in a coil shape.

A single spring unit for the bed mattress including the body spring 10 and the exposure wire spring 20 is fabricated into a spring assembly 2, as shown in FIGS. 2*a* to 2*c*, which is composed of springs arranged apart from one another at regular intervals along row and column directions over the entire area of the bed mattress, and helical coils 26 for securely engaging one side ends of the upper and lower end springs 16 and 18 of adjacent springs for bed mattress with one another.

Here, the spring structure 100 according to the first embodiment of the present invention features that a first contact-preventing end 30 is formed at the connection end portion 24. When a load is applied to the bed mattress and simultaneously the exposure wire spring 20 is compressed, the first contact-preventing end 30 descends while not coming into close contact with an uppermost winding 12 of the body spring 10 positioned just therebelow, to thereby provide an effect of preventing the contact noise.

More specifically, the first contact-preventing end 30 is a wire section bent upwardly (vertically) or inclinedly upwardly (vertically) from a distal end of the upper end spring 16 positioned outwardly from an uppermost winding 12 of the body spring 10.

In other words, when viewed from the top, the first contact-preventing end 30 is disposed outwardly from an uppermost winding 12 of the body spring 10 without being crossed or overlapped. Thus, upon the compression of the exposure wire spring 20 the first contact-preventing end 30 descends while passing by the uppermost winding 12 of the body spring 10 without touching the uppermost winding 12, thereby preventing the contact between the exposure wire spring 20 and the uppermost winding 12 and a noise due to the contact occurring in the conventional spring.

Figure 11A:
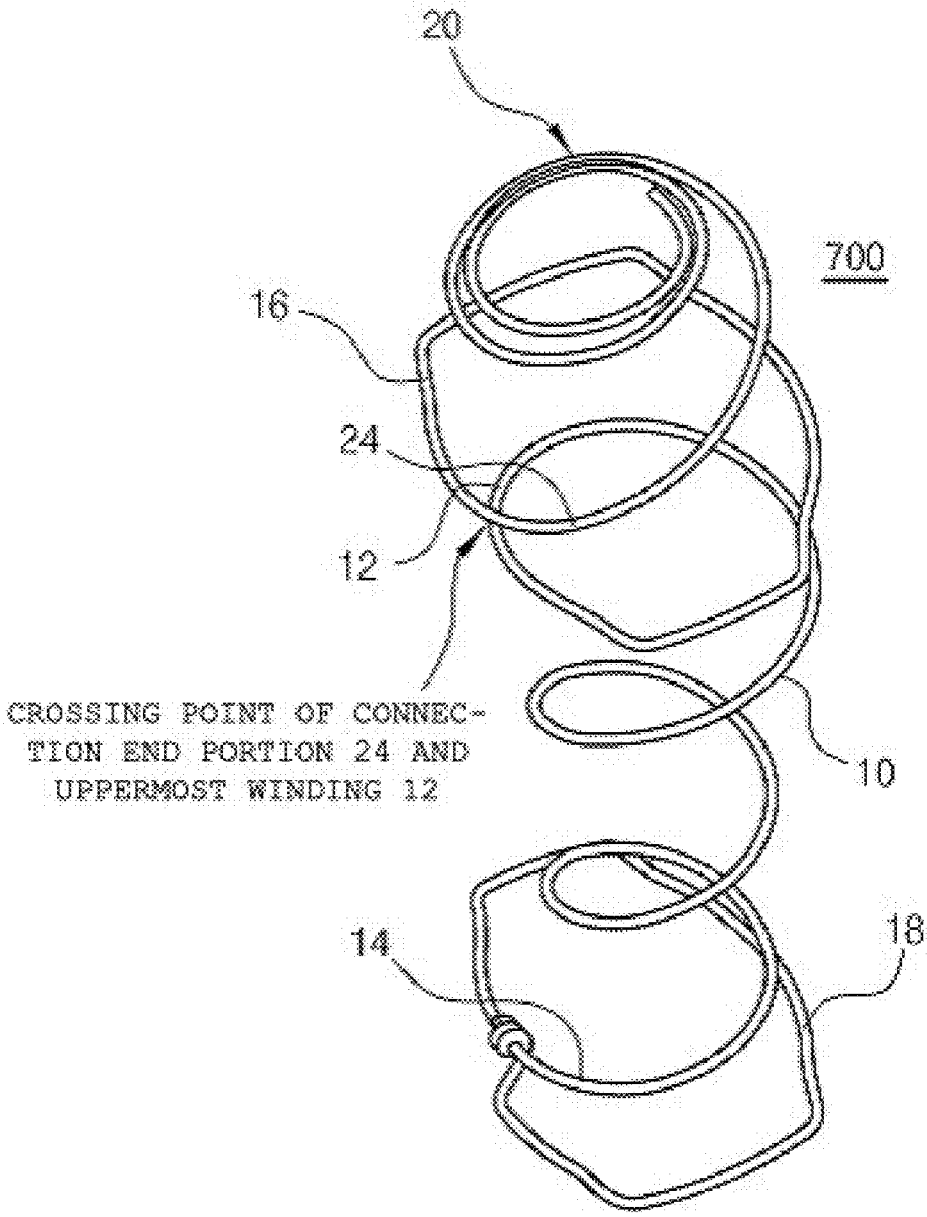
FIG. 11a (Prior Art)
FIGS. 11*a*, 11*b* and 11*c* show another prior art spring structure.
Figure 11B:
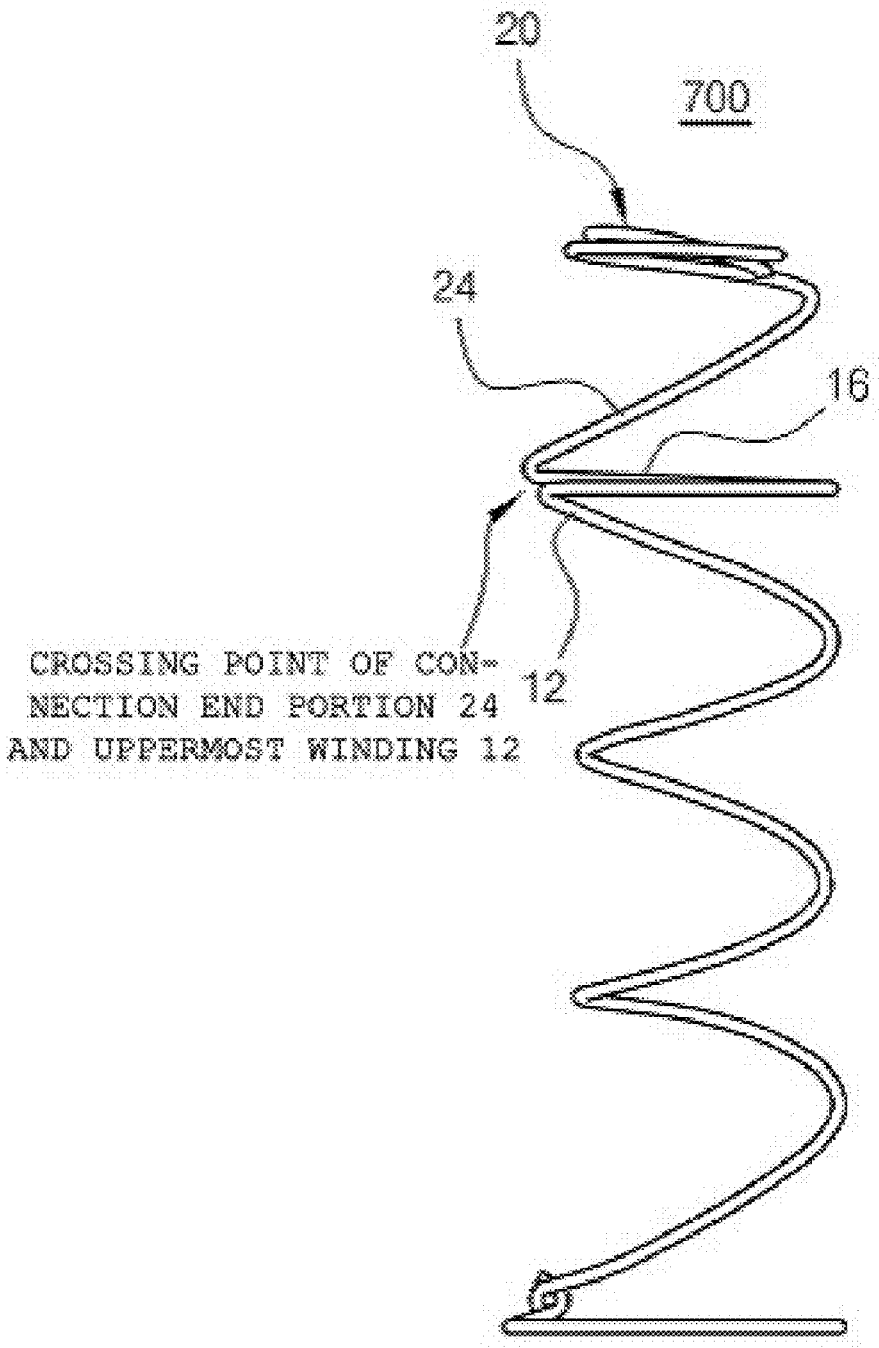
FIG. 11b (Prior Art)
Figure 11C:
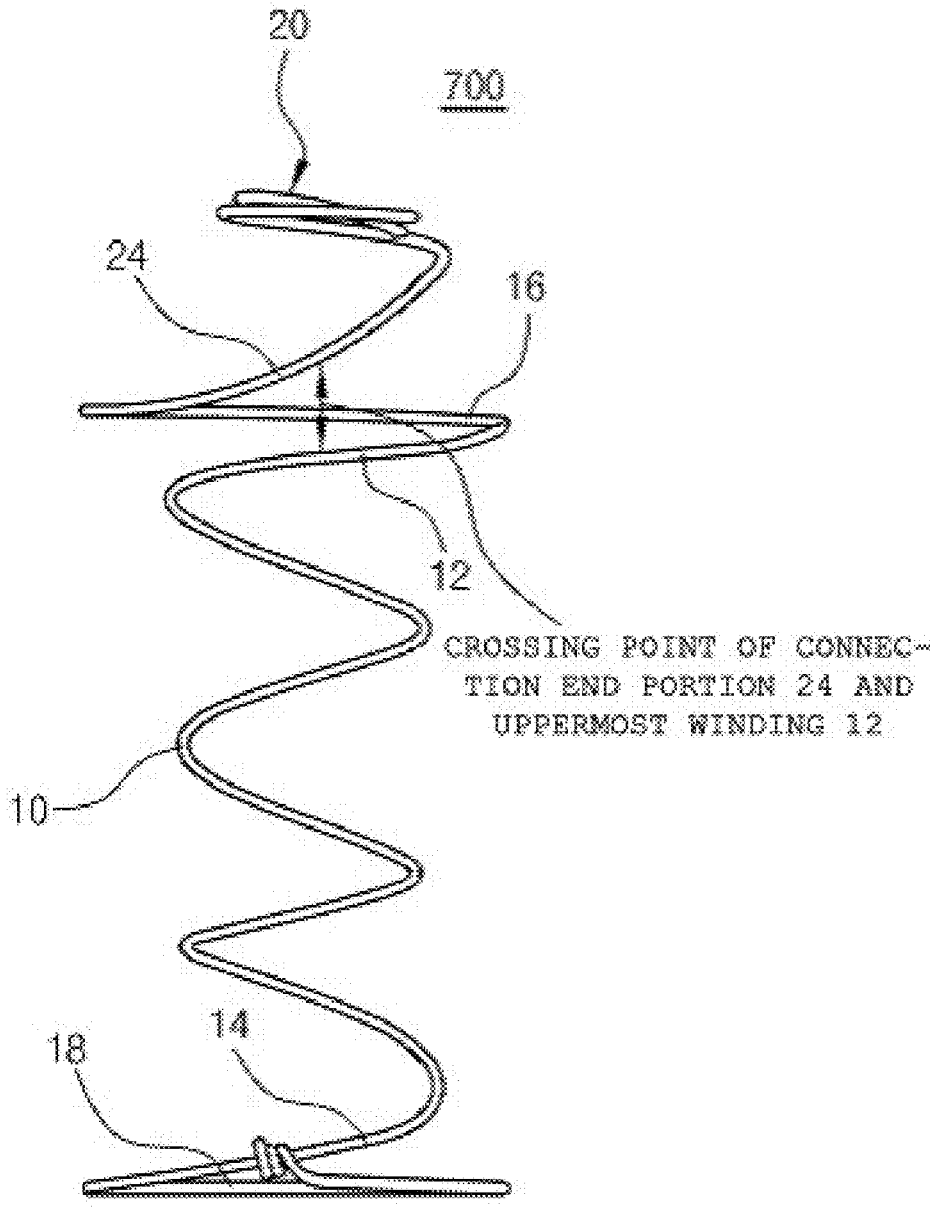
FIG. 11c (Prior Art)
Figure 12:
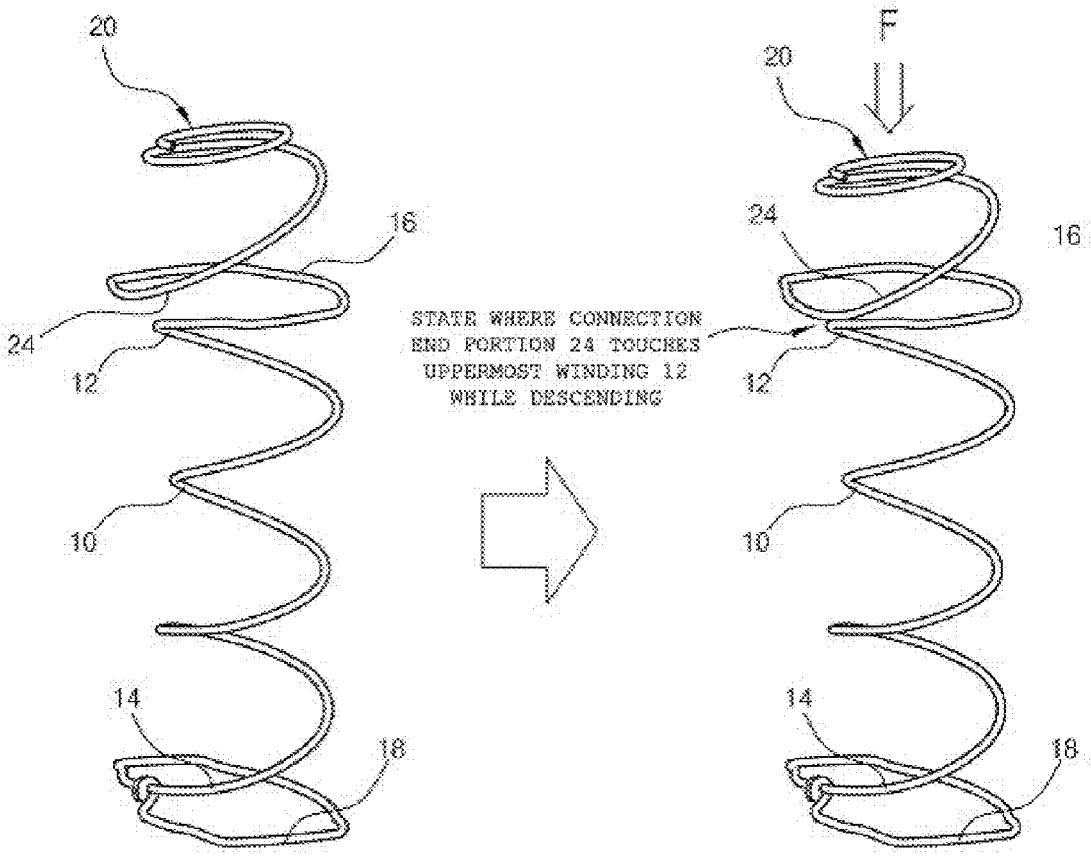
FIG. 12 (Prior Art)
FIG. 12 is a perspective view illustrating the prior art spring structure of FIGS. 11*a* and 11*b* viewed from different angles for the sake of explanation of a disadvantage of the spring.
Figure 13:
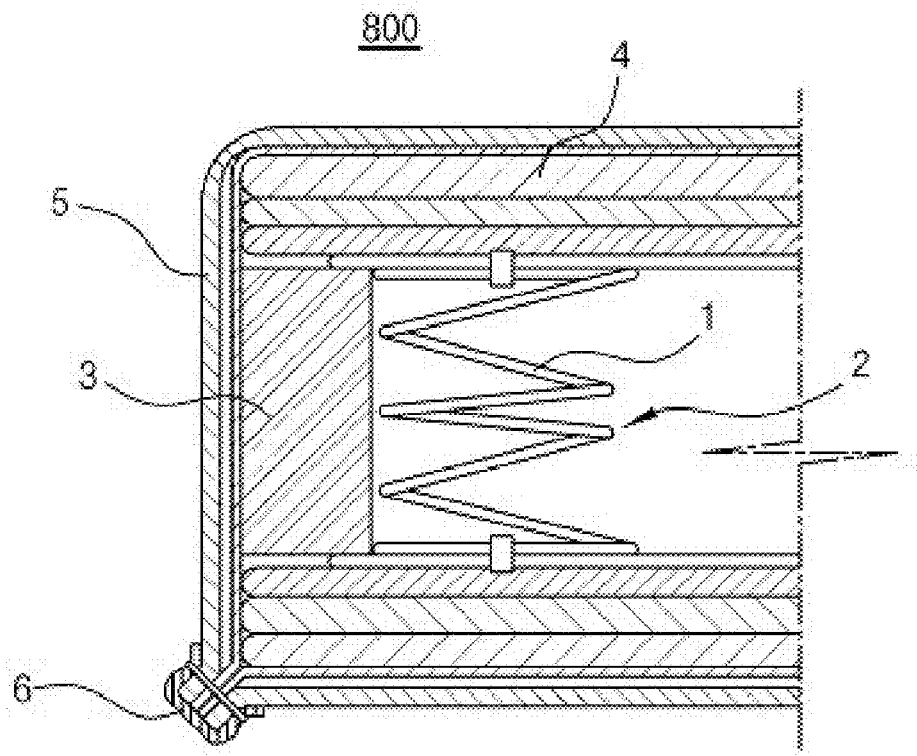
FIG. 13 (Prior Art)
FIG. 13 is a cross-section view illustrating the structure of a prior art bed mattress.

According to the conventional spring structure (see FIGS. 11*a* to 11*c*), a connection end portion 24 for integrally interconnecting a distal end of the upper end spring 16 and the exposure wire spring 20 is crossed with the uppermost winding 12 when viewed from the top while being extended spirally.

Accordingly, when a load is exerted to the bed mattress having the conventional spring structure, the connection end portion 24 descends along with compression of the exposure wire spring 20 and comes into close contact with the uppermost winding 12 of the body spring 10 positioned just therebelow, thereby generating the contact noise.

However, in the spring structure according to the first embodiment of the present invention, as shown in FIGS. 3*a* and 3*b*, the first contact-preventing end 30 is formed at the connection end portion 24. Thus, when a load is exerted to the bed mattress to compress the exposure wire spring 20, the first contact-preventing end 30 descends while passing by the uppermost winding 12 of the body spring 10 positioned just therebelow without touching the uppermost winding 12, thereby fully eliminating the noise itself that can be otherwise caused if there is such contact between the exposure wire spring 20 and the uppermost winding 12.

A spring structure 200 for a bed mattress according to a second embodiment of the present invention will now be described hereinafter.

Figure 4A:
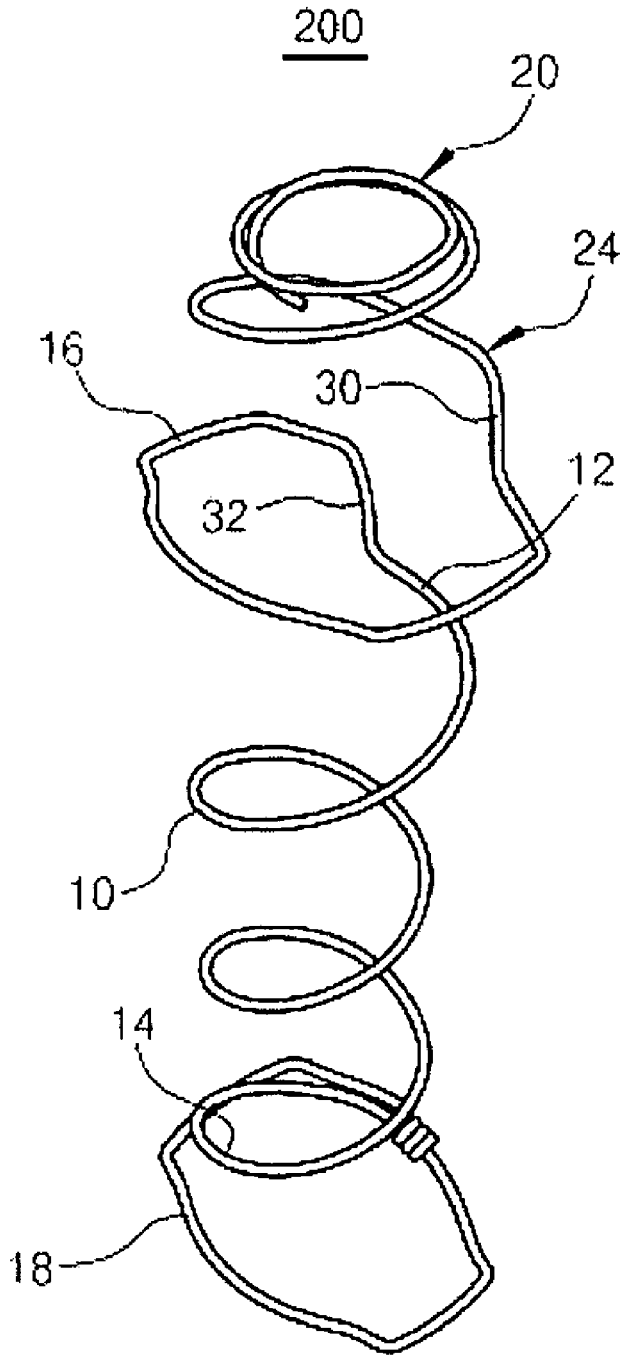
FIGS. 4*a*, 4*b* and 4*c* are a perspective view, a front view, and a side view illustrating a spring structure for a bed mattress according to a second embodiment of the present invention.
Figure 4B:
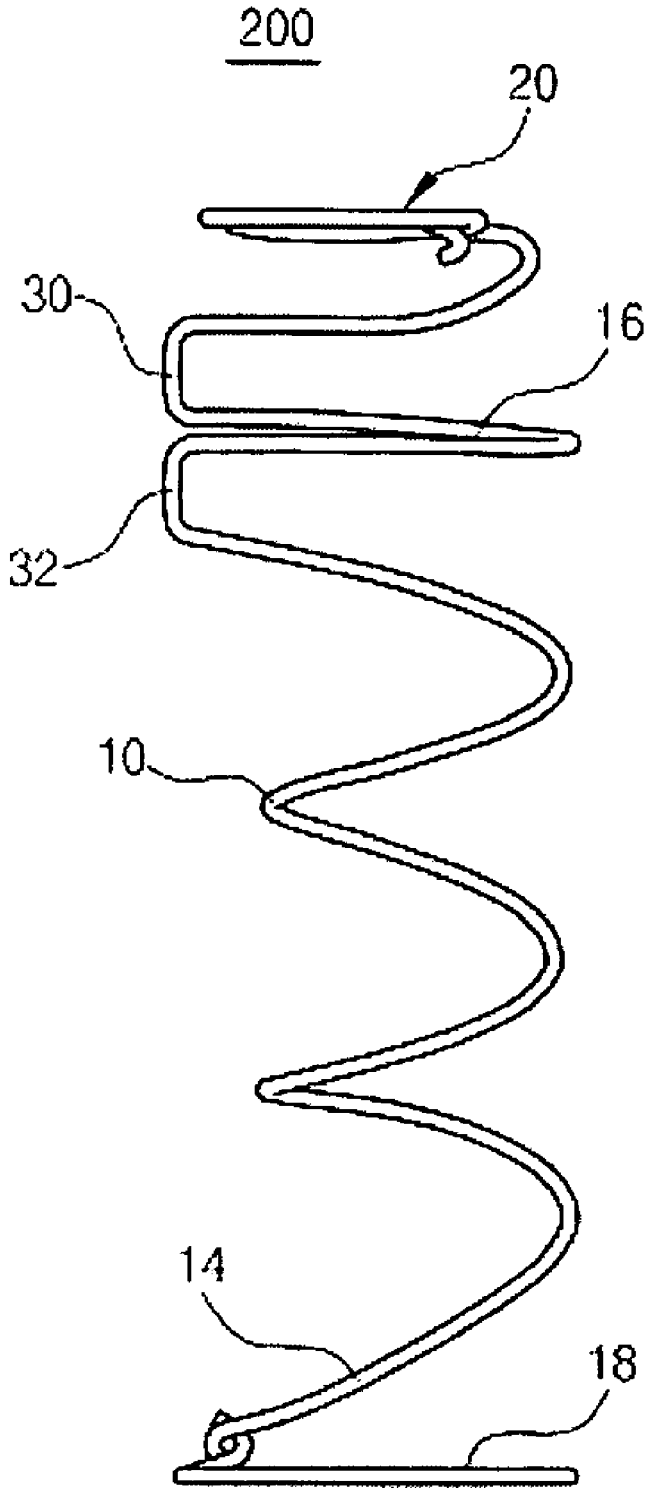
Figure 4C:
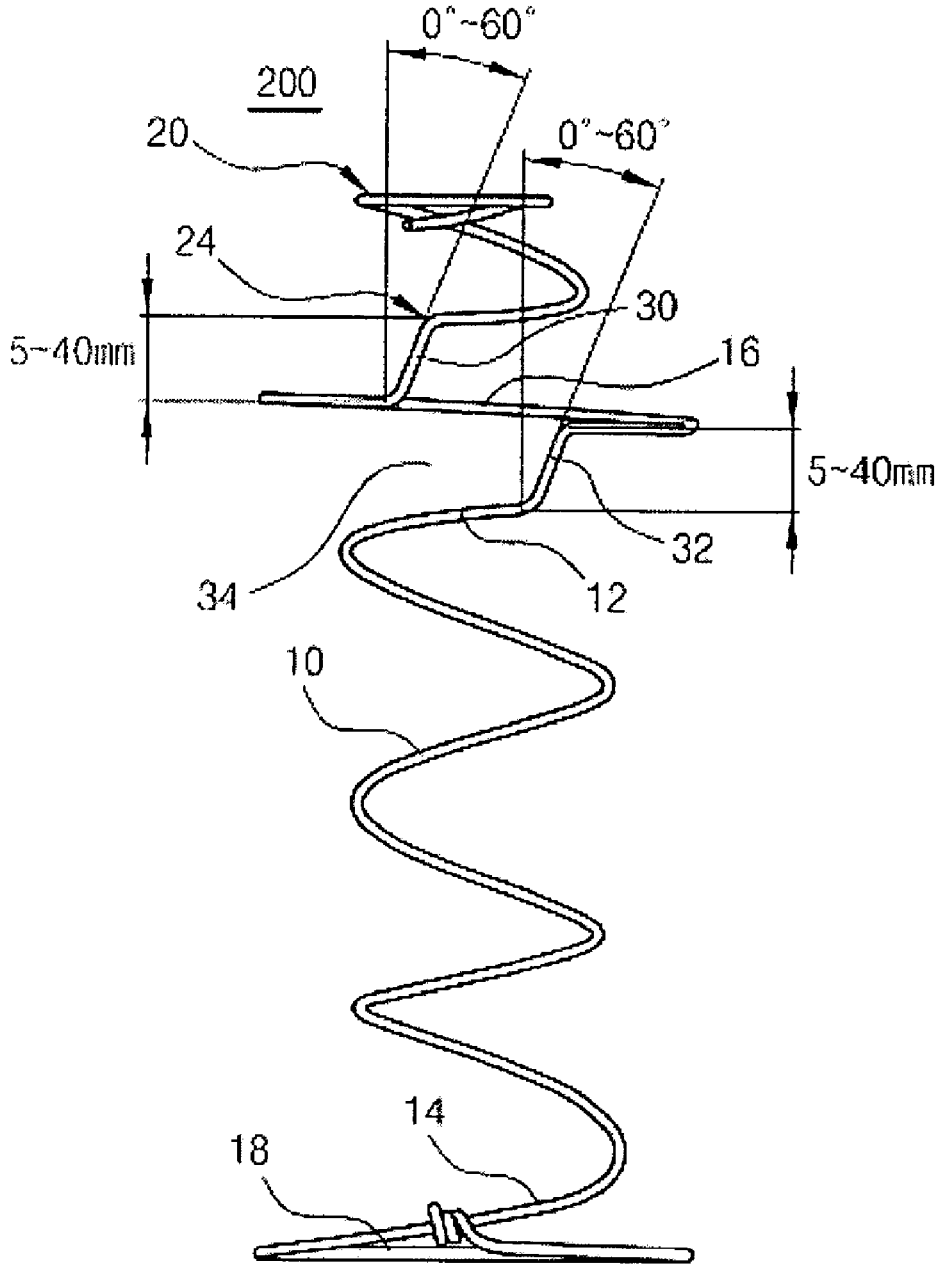
Figure 5A:
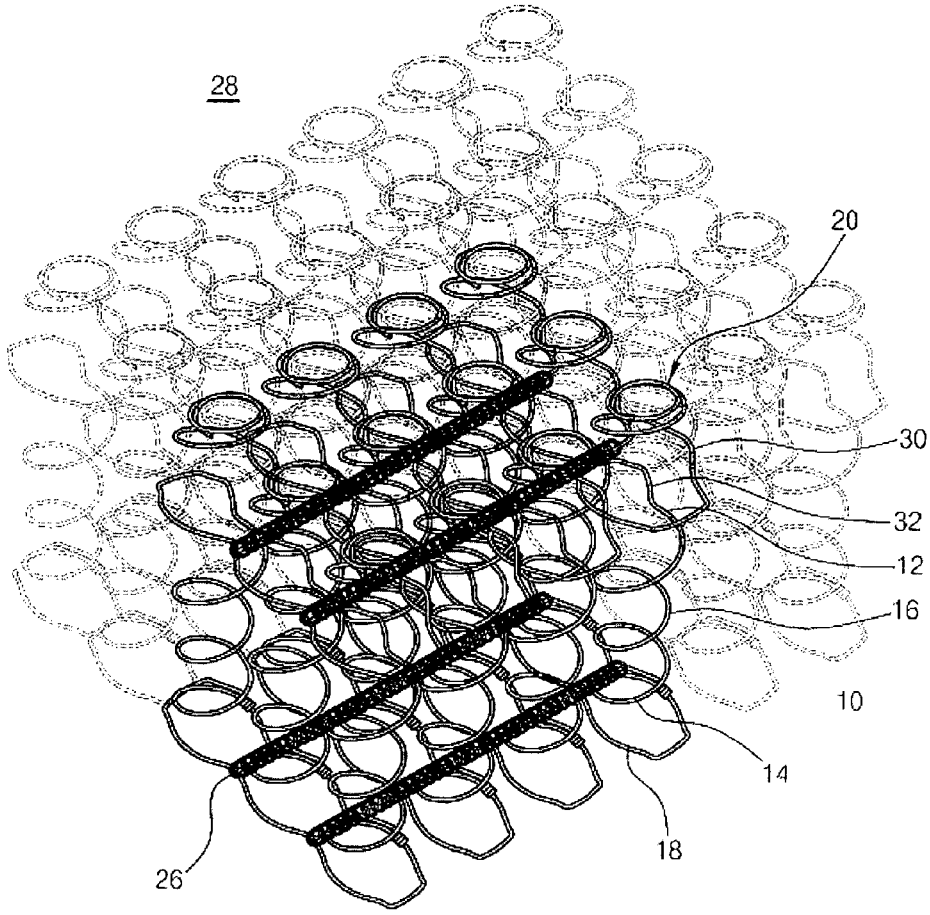
FIGS. 5*a*, 5*b* and 5*c* are a perspective view, a front view, and a side view illustrating the states where the spring structure according to the second embodiment of the present invention is assembled in a spring assembly.
Figure 5B:
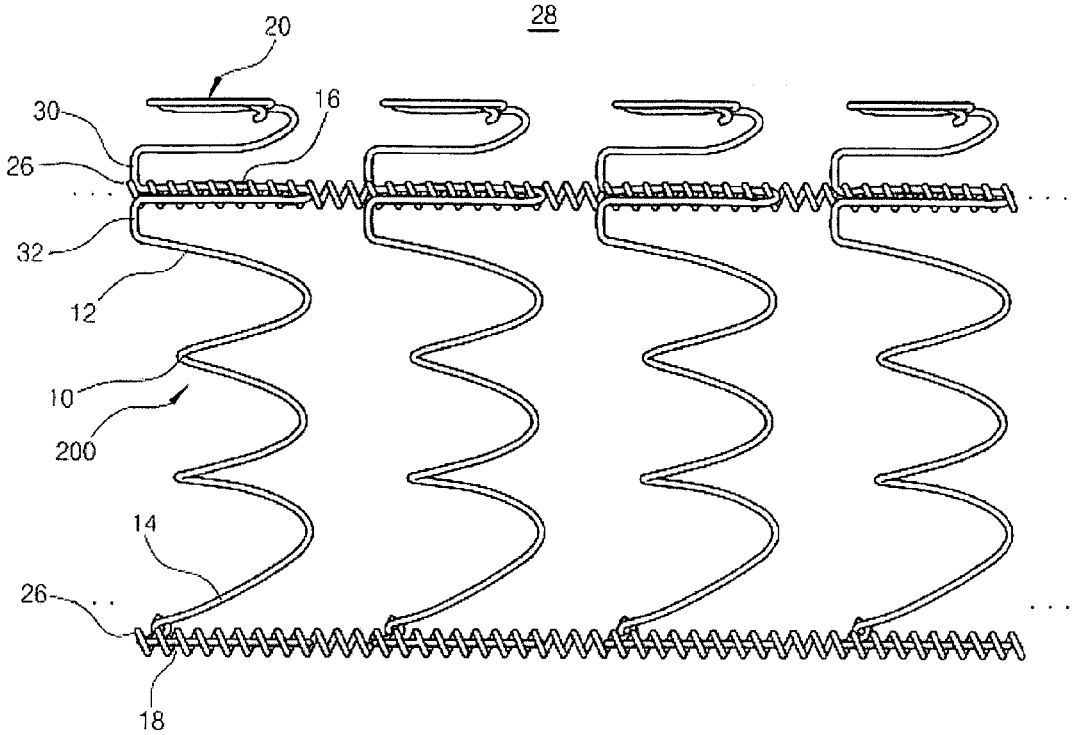
Figure 5C:
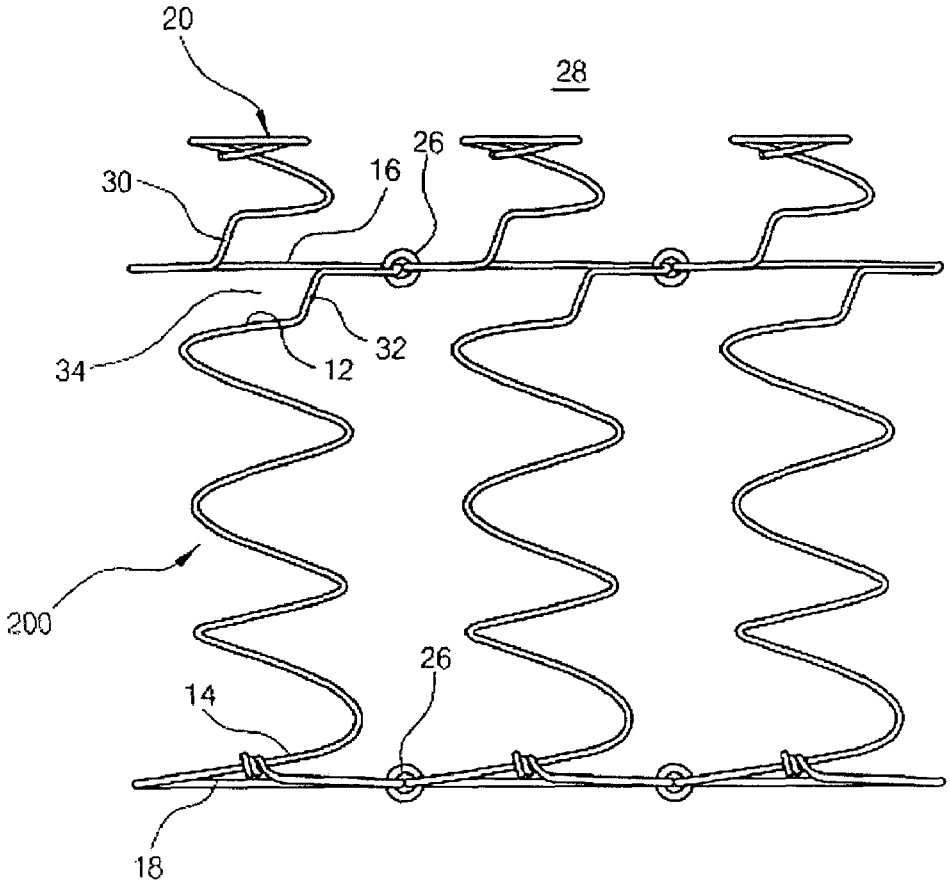
Figure 6A:
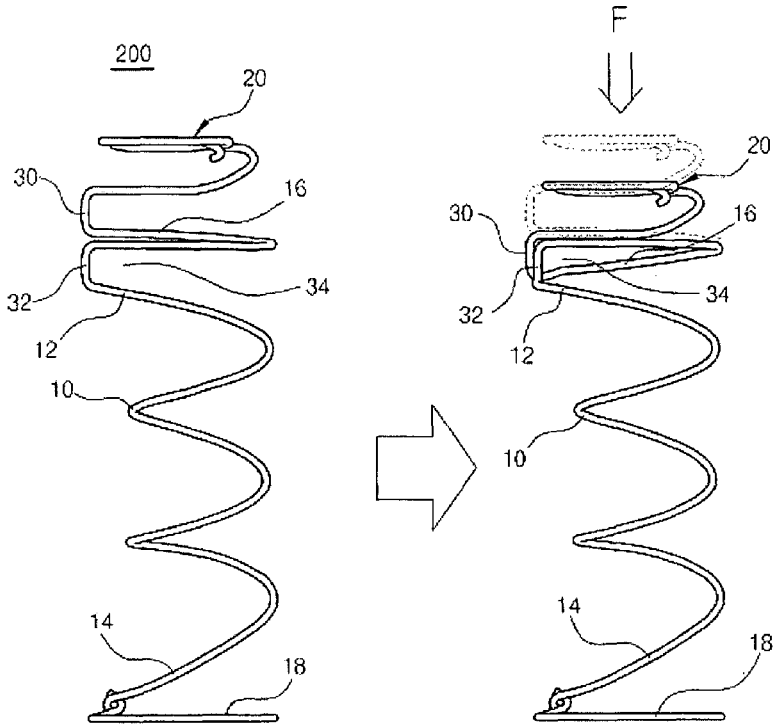
FIGS. 6*a* and 6*b* are a front view and a side view illustrating the compression actions of the spring structure according to the second embodiment of the present invention.
Figure 6B:
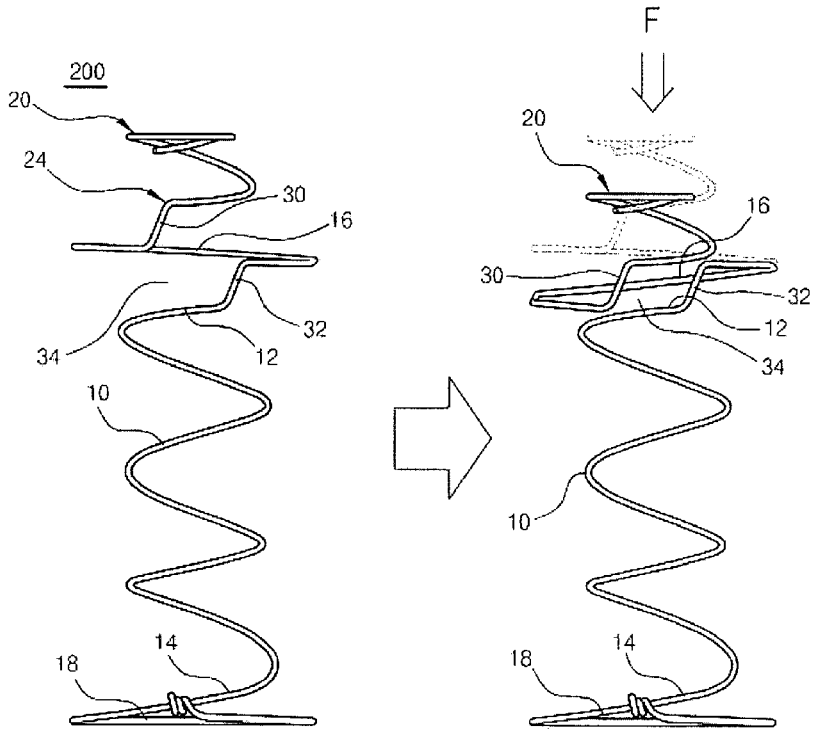

FIGS. 4*a*, 4*b* and 4*c* are a perspective view, a front view, and a side view illustrating a spring for a bed mattress according to a second embodiment of the present invention, FIGS. 5*a*, 5*b* and 5*c* are a perspective view, a front view, and a side view illustrating the states where the spring according to the second embodiment of the present invention is assembled in a spring assembly, and FIGS. 6*a* and 6*b* are a front view and a side view illustrating the compression actions of the spring according to the second embodiment of the present invention.

The spring structure 200 according to the second embodiment of the present invention is identical to the spring structure 100 according to the first embodiment, except that it further includes a second contact-preventing end 32 formed at an uppermost winding 12 of the body spring 10.

More specifically, the second contact-preventing end 32 is a connection section formed between a terminating point of the uppermost winding 12 of the body spring 10 and a starting point of the upper end spring 16 in such a fashion as to be bent upwardly or inclinedly upwardly from the terminating point of the uppermost winding 12 to the starting point of the upper end spring 16.

At this time, as shown in FIG. 4*b*, a space defined behind the second contact-preventing end 32, (i.e., a space defined just above the uppermost winding of the body spring) is used as a contact-preventing space 34. The reason why the contact-preventing space 34 is formed is that when a load is applied to the bed mattress and simultaneously the exposure wire spring 20 is compressed, the first contact-preventing end 30 is located at the space defined behind the second contact-preventing end 32 while descending so that it does not come into close contact with an uppermost winding 12 of the body spring 10.

Figure 4D:
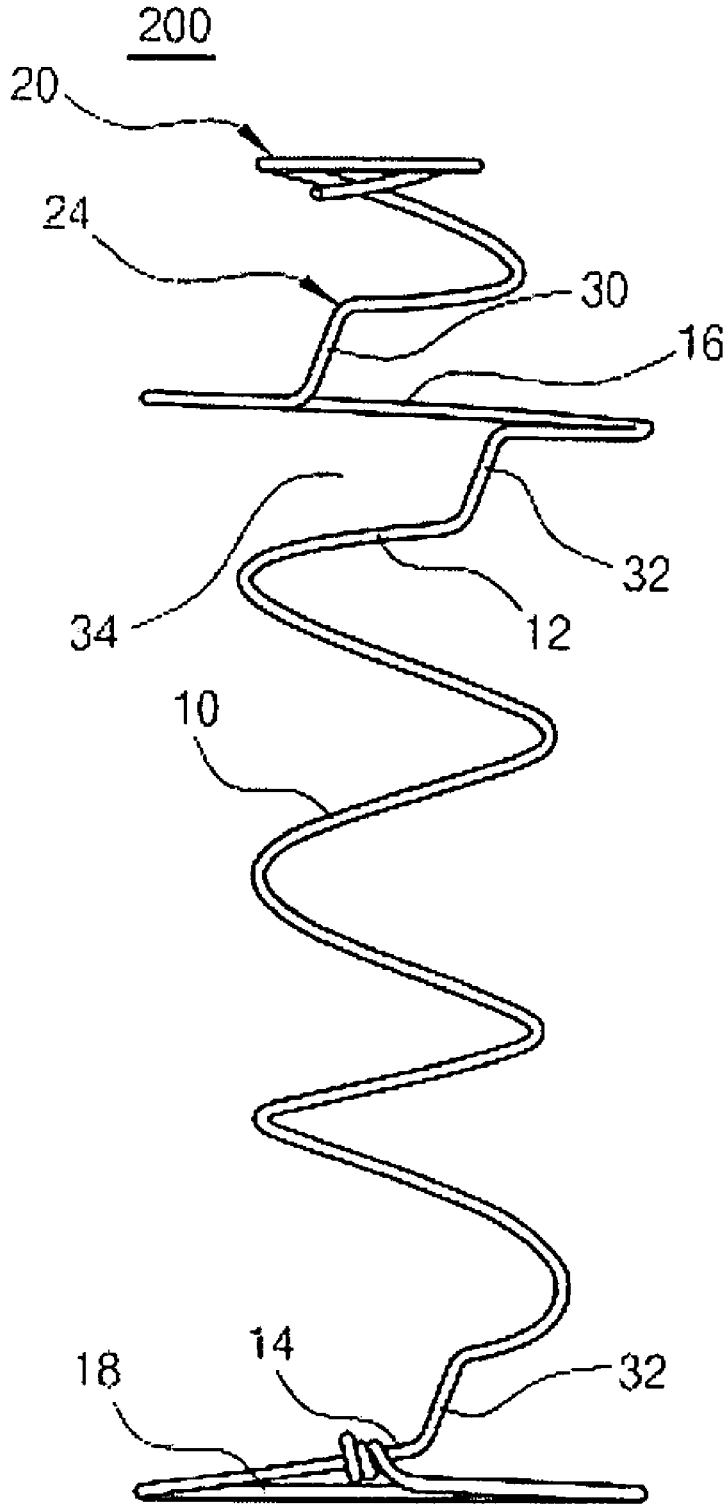
FIG. 4*d* is a side view illustrating a spring structure for a bed mattress which includes an additional contact-preventing end in the spring of FIG. 4*c;*

In a modified embodiment, the spring structure of the second embodiment, as shown in FIG. 4*d*, may further include a fourth contact-preventing end 32 formed at the lowermost winding 14 of the lower end spring 18 to further reinforce the resilient strength of the body spring 10.

That is, as shown in FIGS. 4*d*, 6*a* and 6*b*, when a load is exerted to the bed mattress to compress the exposure wire spring 20, the first contact-preventing end 30 descends and is located at the space defined behind the second contact-preventing end 32, i.e., a contact-preventing space 34 so that the first contact-preventing end 30 and the uppermost winding 12 of the body spring 10 do not come into close contact with each other, thereby fundamentally preventing generation of the noise due to the contact between the exposure wire spring 20 and the uppermost winding 12. In addition, when the first contact-preventing end 30 descends, the fourth contact-preventing end 32 formed at the lowermost winding 14 of the body spring 10 acts to support the body spring 10 so as to further reinforce the resilient strength of the body spring 10.

If a significantly large load is applied to the bed mattress, the first contact-preventing end 30 passes by the contact-preventing space 34 of the second contact-preventing end 32 and then descends further toward the uppermost winding 12. But at this time, the first contact-preventing end 30 descends outwardly from the uppermost winding 12 of the body spring 10 without touching the uppermost winding 12, so that although a larger load is exerted to the bed mattress, there is not any contact between the first contact-preventing end 30 and the uppermost winding 12 of the body spring 10.

As such, in the spring structures 100 and 200 according to the first and second embodiments of the present invention, noise is not generated.

Figure 7:
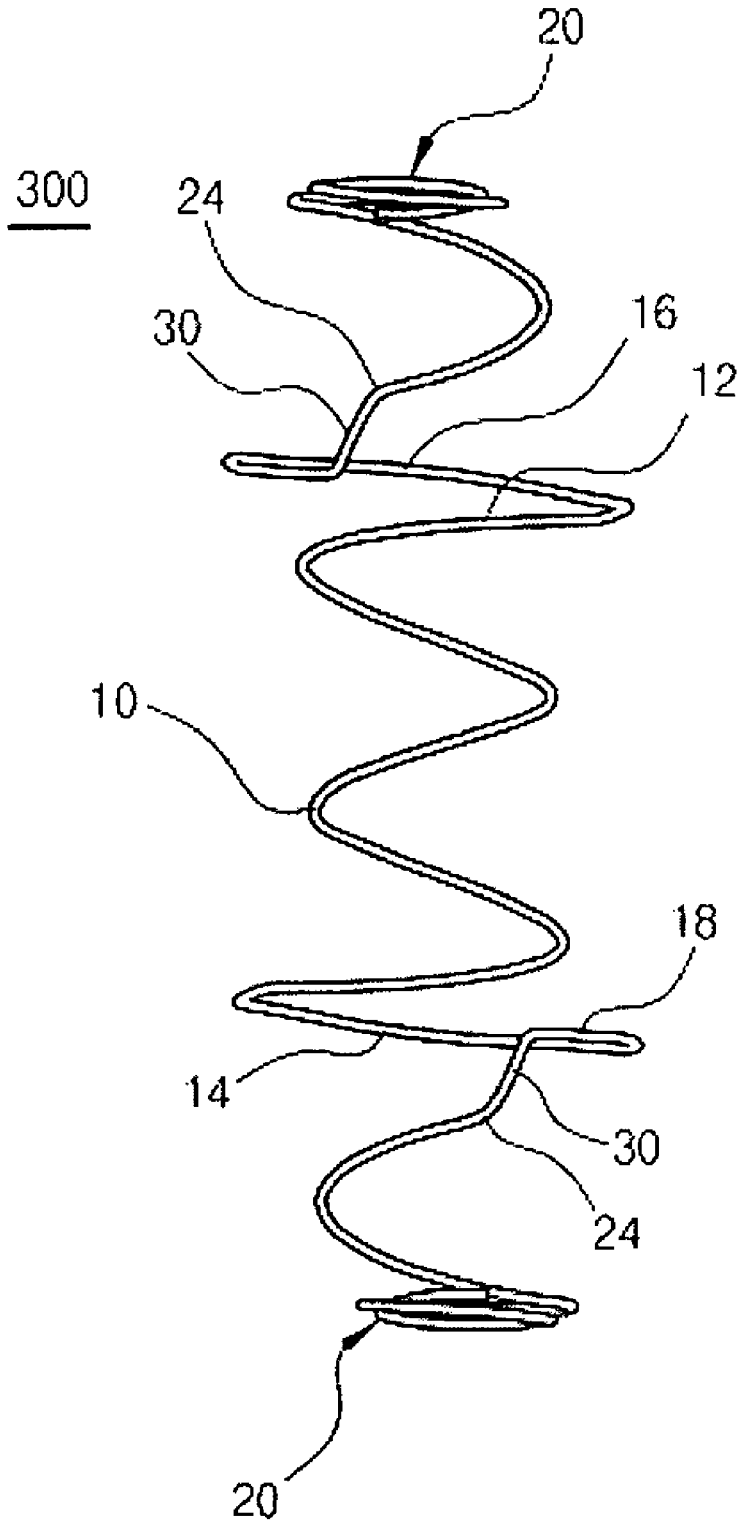
FIG. 7 is a side view illustrating a spring structure for a bed mattress according to a third embodiment of the present invention.

FIG. 7 is a side view illustrating a spring structure 300 for a bed mattress according to a third embodiment of the present invention. The spring structure of the third embodiment is identical to the spring structure of the first embodiment except that it further includes a fourth contact-preventing end.

The spring structure 300 according to the third embodiment is identical to that of the first embodiment except that it further includes a third contact-preventing end. More specifically, an upper exposure wire spring 20 is connected integrally with the upper end spring 16 in such a fashion as to be disposed above the upper end spring 16 and a lower exposure wire spring 20 is connected integrally with the lower end spring 18 in such a fashion as to be disposed below the lower end spring 18. The spring structure 300 further includes a third contact-preventing end 30 is formed between the lower end spring 18 and the lower exposure wire spring 20 for the purpose of prevention of the noise due to any contact therebetween.

Figure 8:
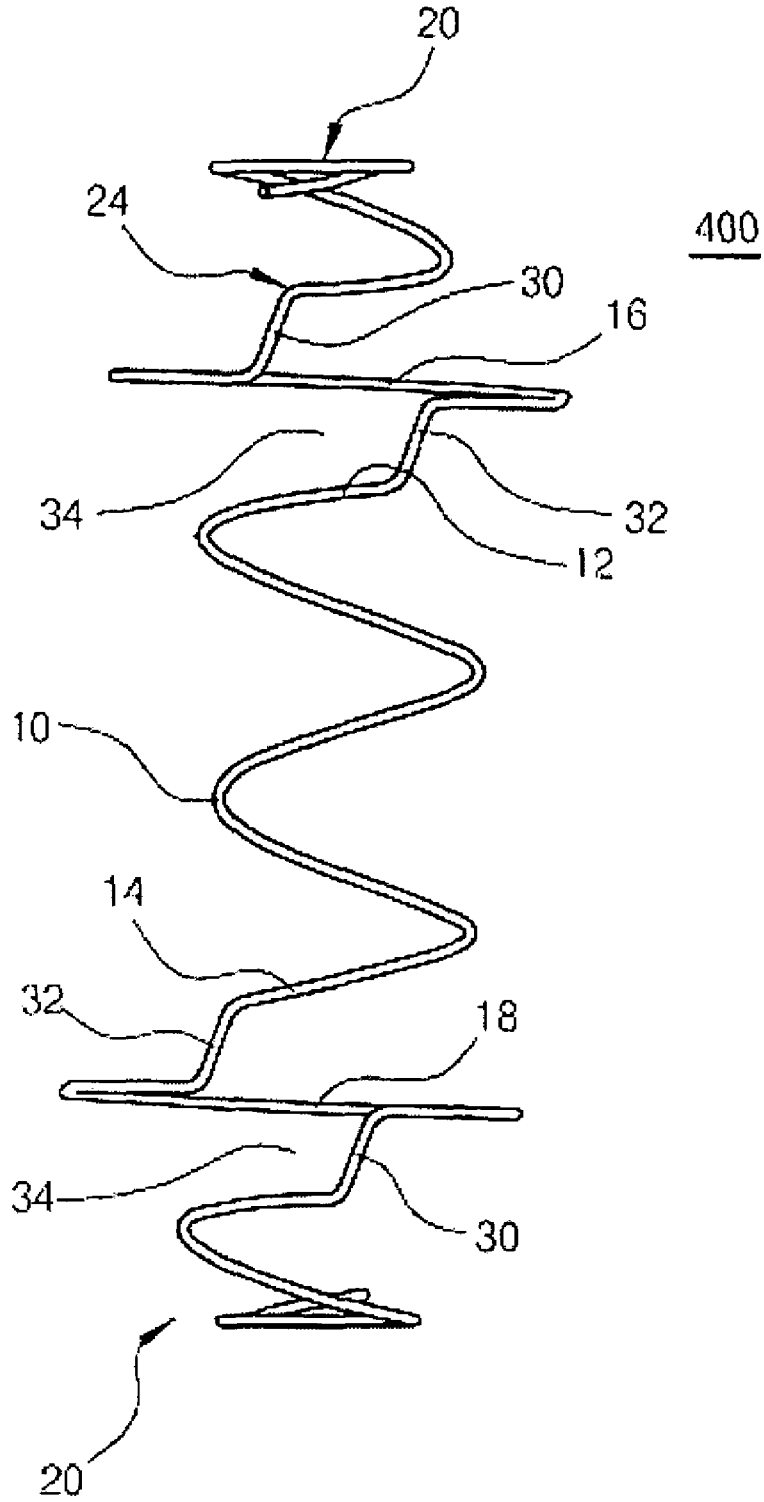
FIG. 8 is a side view illustrating a spring structure for a bed mattress according to a fourth embodiment of the present invention.

FIG. 8 is a side view illustrating a spring structure 400 for a bed mattress according to a fourth embodiment of the present invention. The spring structure 400 of the fourth embodiment is identical to that of the second embodiment except that it further includes a third contact-preventing end and a fourth contact-preventing end.

More particularly, an upper exposure wire spring 20 is connected integrally with the upper end spring 16 in such a fashion as to be disposed above the upper end spring 16 and a lower exposure 20 is connected integrally with the lower end spring 18 in such a fashion as to be disposed below the lower end spring 18. The spring structure 400 further includes a third contact-preventing end 30 formed between the lower end spring 18 and the lower exposure wire spring 20, and a fourth contact-preventing end 32 formed between the lower end spring 18 and the lowermost winding 14 of the body spring 10.

Figure 9A:
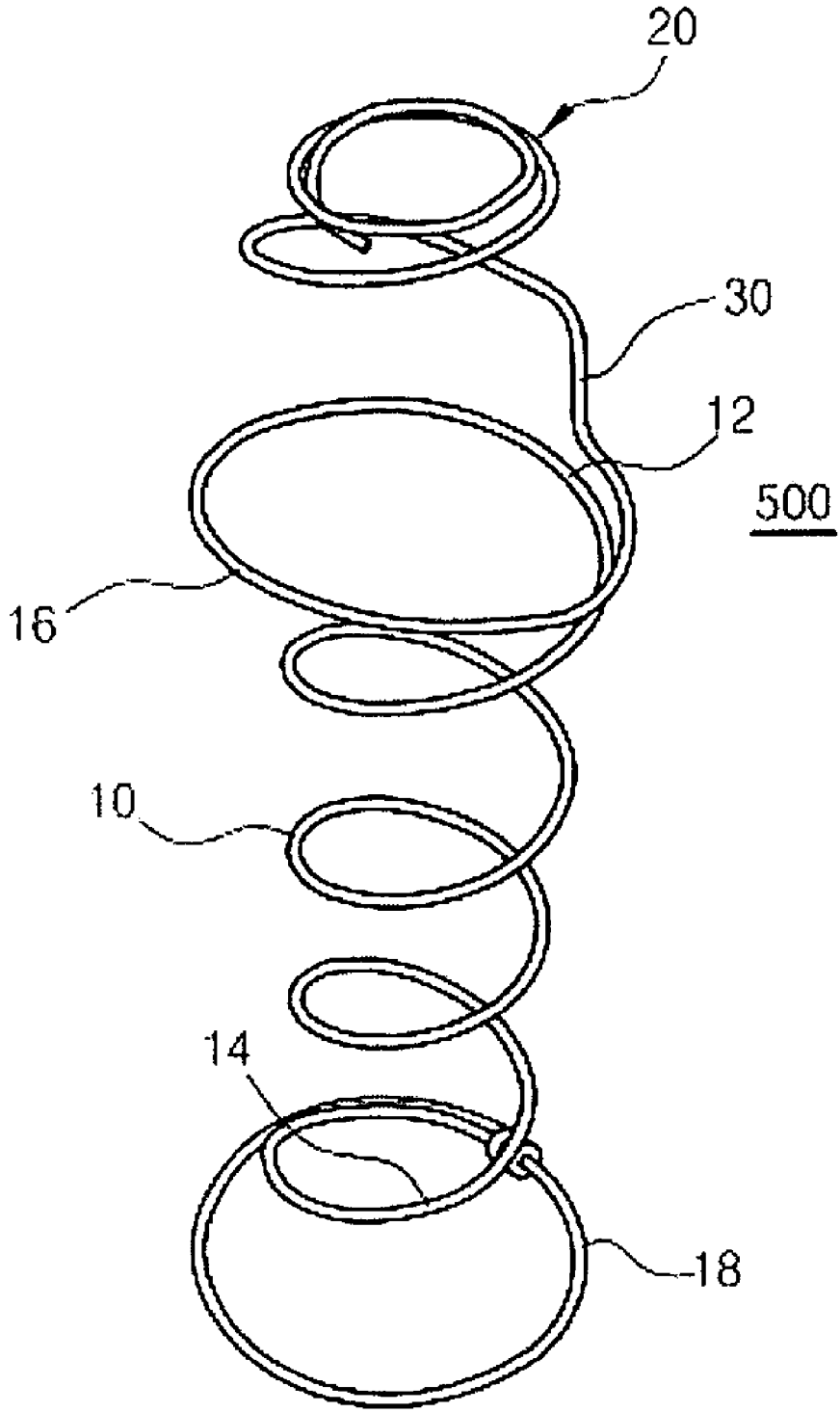
Figure 9B:
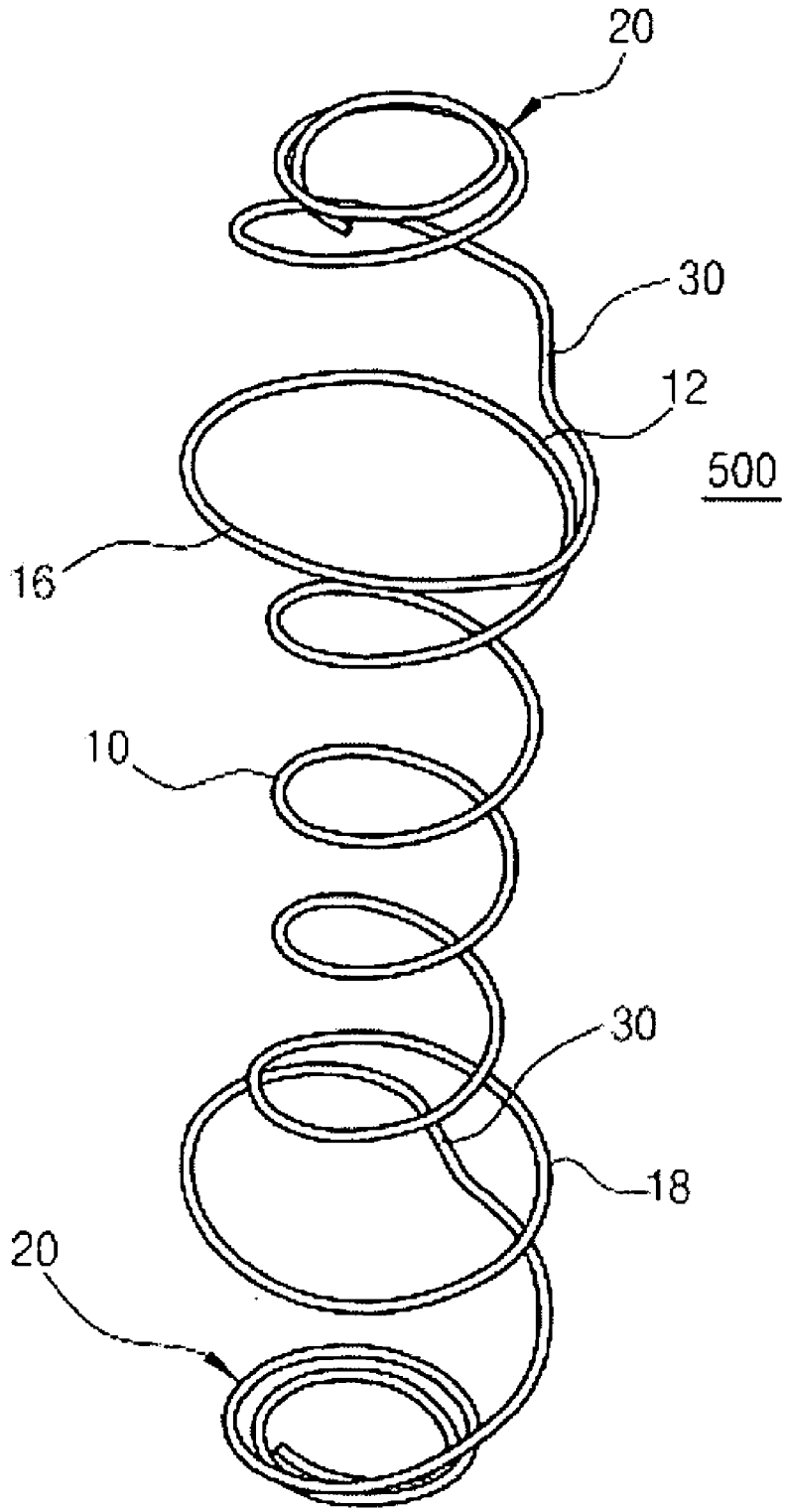
Figure 10A:
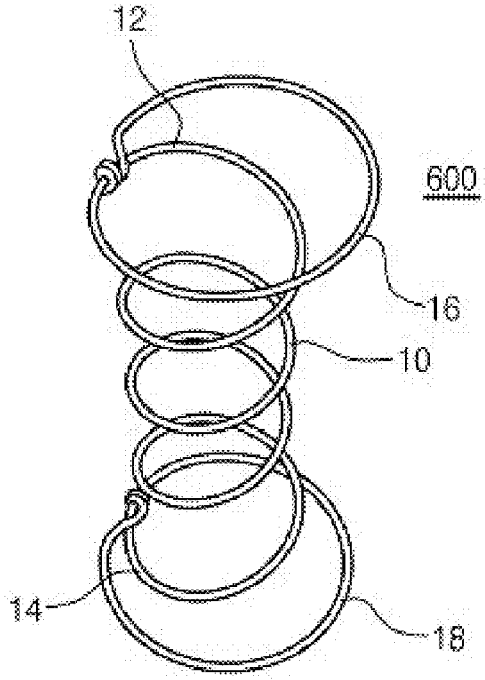
FIG. 10a (Prior Art)
FIGS. 10*a* and 10*b* are a perspective view and a side view illustrating a prior art spring structure.
Figure 10B:
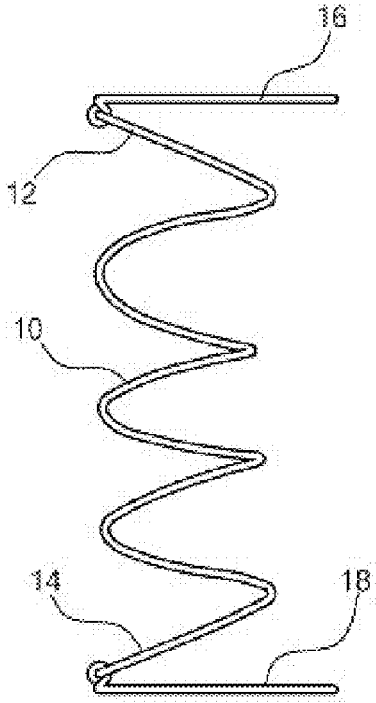
FIG. 10b (Prior Art)

FIGS. 9*a* and 9*b* are perspective views illustrating a spring structure 500 for a bed mattress according to a fifth embodiment of the present invention, in which an exposure wire spring 20 is connected to an upper end portion of a conventional coil spring.

More specifically, the spring structure 500 according to the fifth embodiment shown in FIGS. 9*a* and 9*b* is characterized in that the exposure wire spring 20 is connected integrally with the upper end spring 16 of a conventional coil shape in such a fashion as to be disposed above the upper end spring 16, or integrally with both the upper end spring 16 and the lower end spring 18 in such a fashion as to be disposed above the upper end spring 16 and below the lower end spring 18. The spring structure 500 includes a first contact-preventing end 30 formed between the upper end spring 16 and the exposure wire spring 20. Alternatively, the spring structure 500 includes, in addition to the first contact-preventing end 30, a third contact-preventing end 30 between the lower end spring 18 and a lower exposure wire spring 20.

As such, according to the present invention, the exposure wire spring 20 may be connected to the upper end spring of the body spring 10, or the upper end spring and the lower end spring of the body spring 10 irrespective of the kind of the spring. In case of such connection of the exposure wire spring 20, the first contact-preventing end 30 alone is formed or the first contact-preventing end 30 and at least one of the second, third, and fourth contact-preventing ends 30 and 32 are formed to prevent the contact between the springs and a resulting noise.

In the meantime, the height of the first and second contact-preventing ends is in the range between 5 to 40 mm. The reason of limiting the height is that if the height thereof is less than 5 mm, the formation itself of the first and second contact-preventing ends 30 and 32 are difficult, and if the height thereof is more than 40 mm, the intrinsic property of the spring is lost.

In addition, the inclination angle of the first and second contact-preventing ends 30 and 32 with respect to a vertical axis of the body spring 10 is limited to the range between 0° and 60°. The reason of limiting the inclination angle is that if the inclination angle is 0°, the rigidity of the exposure wire spring 20 is the most favorable, and if the inclination angle is more than 60°, the rigidity of the exposure wire spring 20 becomes weak and the impact-absorbing capacity of the exposure wire spring 20 is deteriorated.

The spring according to the respective embodiments of the present invention as described above is a spring having a dual buffer structure fabricated by any one of the following steps of:

i) forming the first contact-preventing end 30 at a connection portion extending between the upper end spring 16 and the exposure wire spring 20 positioned above the upper end spring 16, ii) forming the first contact-preventing end 30 at a connection portion extending between the upper end spring 16 and the exposure wire spring 20 positioned above the upper end spring 16, and forming the second contact-preventing end 32 at a portion extending from the uppermost winding 12 of the body spring 10 to the upper end spring 16, iii) forming the first contact-preventing end 30 at a connection portion extending between the upper end spring 16 and the exposure wire spring 20 positioned above the upper end spring 16, and further forming the third contact-preventing end 30 at a connection portion extending between the lower end spring 18 and the exposure wire spring 20 positioned below the lower end spring 18, iv) forming the first contact-preventing end 30 at a connection portion extending between the upper end spring 16 and the exposure wire spring 20 positioned above the upper end spring 16, forming the second contact-preventing end 32 at a portion extending from the uppermost winding 12 of the body spring 10 to the upper end spring 16, forming the third contact-preventing end 30 at a connection portion extending between the lower end spring 18 and the exposure wire spring 20 positioned below the lower end spring 18, and forming the fourth contact-preventing end 32 at a portion extending from the lower end spring 18 to the lowermost winding 14 of the body spring 10, and v) forming the first contact-preventing end 30 at a connection portion extending between the upper end spring 16 and the exposure wire spring 20 positioned above the upper end spring 16, forming the second contact-preventing end 32 at a portion extending from the uppermost winding 12 of the body spring 10 to the upper end spring 16, and forming the fourth contact-preventing end 32 at a portion extending from the lower end spring 18 to the lowermost winding 14 of the body spring 10.

In the spring having the dual buffering structure, the body spring and the exposure wire spring perform a buffering function thereof separately depending on the magnitude of the load exerted to the bed mattress to thereby provide advantages of preventing the deformation of the spring and prolonging the lifespan of the spring. The rigidity of the spring is further enhanced by means of the first contact preventing end 30, or the first and second contact-preventing end 30 and 32, to thereby fundamentally prevent the contact noise.

As apparent from the foregoing, according to the inventive spring structure for a bed mattress, the structure of a connection end portion for connecting a body spring and an exposure wire spring to each other is improved such that the connection end portion is not in close contact with an uppermost winding of the body spring, so that the following merits are provided:

a) The first contact-preventing end is formed at a connection end portion extending between the body spring and the upper exposure wire spring, so that when the exposure wire spring is compressed by means of a load exerted to the bed mattress, the first contact-preventing end does not bring into contact with the uppermost winding of the body spring while descending, thereby easily preventing a deformation of the spring due to a frictional contact and fundamentally preventing a contact noise.

b) The second contact-preventing end is further formed between the upper end spring and the body spring in addition to the first contact-preventing end, so that the first contact-preventing end is positioned at the space defined behind the second contact-preventing end while descending or passes by the uppermost winding of the body spring without touching the uppermost winding while descending, thereby further easily preventing a deformation of the spring due to a frictional contact and fundamentally preventing a contact noise.

c) The first contact-preventing end is formed at a connection end portion extending between the body spring and the exposure wire spring, thereby further enhancing the resilient strength of the spring to significantly prolong the lifespan of the spring accordingly.

While the present invention has been described with reference to the particular illustrative embodiments, it is not to be restricted by the embodiments but only by the appended claims. It is to be appreciated that those skilled in the art can change or modify the embodiments without departing from the scope and spirit of the present invention.

What is claimed is:

1. A spring structure in a bed mattress which comprises a body spring formed in a coil shape, upper and lower end springs wound and extending horizontally at upper and lower portions of the body spring, a first exposure wire spring formed integrally with the upper end spring and being disposed above the upper end spring, and a first connection end portion integrally connecting the upper end spring and the first exposure wire spring to each other, wherein a first contact-preventing end is formed at the first connection end portion, said first contact-preventing end being bent upwardly or inclinedly upwardly from a distal end of the upper end spring positioned outwardly from an uppermost winding of the body spring preventing the first exposure wire spring from contacting the uppermost winding of the body spring and the upper end spring when a compression force is applied to the first exposure wire spring.

2. A spring structure in a bed mattress which comprises a body spring formed in a coil shape, upper and lower end springs wound and extending horizontally at upper and lower portions of the body spring, a first exposure wire spring formed integrally with the upper end spring and being disposed above the upper end spring, and a first connection end portion integrally connecting the upper end spring and the first exposure wire spring to each other, wherein a first contact-preventing end is formed at the first connection end portion, said first contact-preventing end being bent upwardly or inclinedly upwardly from a distal end of the upper end spring positioned outwardly from an uppermost winding of the body spring preventing the first exposure wire spring from contacting the uppermost winding of the body spring and the upper end spring when a compression force is applied to the first exposure wire spring, and wherein a second contact-preventing end is formed at the uppermost winding of the body spring positioned below the first contact-preventing end, said second contact-preventing end being bent upwardly or inclinedly upwardly from a terminating point of the uppermost winding of the body spring to a starting point of the upper end spring preventing the first contact preventing end from contacting the uppermost winding of the body spring when said compression force is applied to the first exposure wire spring.

3. A spring structure in a bed mattress which comprises a body spring formed in a coil shape, upper and lower end springs wound and extending horizontally at upper and lower portions of the body spring, a first exposure wire spring formed integrally with the upper end spring and being disposed above the upper end spring, a first connection end portion integrally connecting the upper end spring and the first exposure wire spring to each other, a second exposure wire spring formed integrally with the lower end spring and being disposed below the lower end spring, and a second connection end portion integrally connecting the lower end spring and the second exposure wire spring to each other, wherein a first contact-preventing end is formed at the first connection end portion, said first contact-preventing end being bent upwardly or inclinedly upwardly from a distal end of the upper end spring positioned outwardly from an uppermost winding of the body spring preventing the first exposure wire spring from contacting the uppermost winding of the body spring and the upper end spring when a compression force is applied to the first exposure wire spring, and wherein a third contact-preventing end is formed at the second connection end portion, said third contact-preventing end being bent downwardly or inclinedly downwardly from a distal end of the lower end spring positioned outwardly from a lowermost winding of the body spring preventing the second exposure wire spring from contacting the lowermost winding of the body spring and the lower end spring when said compression force is applied to the first exposure wire spring.

4. A spring structure in a bed mattress which comprises a body spring formed in a coil shape, upper and lower end springs wound and extending horizontally at upper and lower portions of the body spring, a first exposure wire spring formed integrally with the upper end spring and being disposed above the upper end spring, a first connection end portion integrally connecting the upper end spring and the first exposure wire spring to each other, a second exposure wire spring formed integrally with the lower end spring and being disposed below the lower end spring, and a second connection end portion integrally connecting the lower end spring and the second exposure wire spring to each other, wherein a first contact-preventing end is formed at the first connection end portion, said first contact-preventing end being bent upwardly or inclinedly upwardly from a distal end of the upper end spring positioned outwardly from an uppermost winding of the body spring preventing the first exposure wire spring from contacting the uppermost winding of the body spring and the upper end spring when a compression force is applied to the first exposure wire spring, wherein a second contact-preventing end is formed at the uppermost winding of the body spring positioned below the first contact-preventing end, said second contact-preventing end being bent upwardly or inclinedly upwardly from a terminating point of the uppermost winding of the body spring to a starting point of the upper end spring preventing the first contact preventing end from contacting the uppermost winding of the body spring when said compression force is applied to the first exposure wire spring, wherein a third contact-preventing end is formed at the second connection end portion, said third contact-preventing end being bent downwardly or inclinedly downwardly from a distal end of the lower end spring positioned outwardly from a lowermost winding of the body spring preventing the second exposure wire spring from contacting the lowermost winding of the body spring and the lower end spring when said compression force is applied to the first exposure wire spring, and wherein a fourth contact-preventing end is formed at the lowermost winding of the body spring positioned above the third contact-preventing end, said fourth contact-preventing end being bent downwardly or inclinedly downwardly from a terminating point of the lowermost winding of the body spring to a starting point of the lower end spring reinforcing resilient strength of the body spring.

5. A spring structure in a bed mattress which comprises a body spring formed in a coil shape, upper and lower end springs wound and extending horizontally at upper and lower portions of the body spring, a first exposure wire spring formed integrally with the upper end spring and being disposed above the upper end spring, a first connection end portion integrally connecting the upper end spring and the first exposure wire spring to each other, wherein a first contact-preventing end is formed at the first connection end portion, said first contact-preventing end being bent upwardly or inclinedly upwardly from a distal end of the upper end spring positioned outwardly from an uppermost winding of the body spring preventing the first exposure wire spring from contacting the uppermost winding of the body spring and the upper end spring when a compression force is applied to the first exposure wire spring, wherein a second contact-preventing end is formed at the uppermost winding of the body spring positioned below the first contact-preventing end, said second contact-preventing end being bent upwardly or inclinedly upwardly from a terminating point of the uppermost winding of the body spring to a starting point of the upper end spring preventing the first contact preventing end from contacting the uppermost winding of the body spring when said compression force is applied to the first exposure wire spring, and wherein a fourth contact-preventing end is formed at a lowermost winding of the body spring, said fourth contact-preventing end being bent downwardly or inclinedly downwardly from a terminating point of the lowermost winding of the body spring to a starting point of the lower end spring reinforcing resilient strength of the body spring.

6. The spring structure as in any one of claims 1 to 5, wherein the first contact-preventing end has a height of 5 to 40 mm.

7. The spring structure as in any one of claims 1 to 5, wherein the inclination angle of the first contact-preventing end with respect to a vertical axis of the body spring is not greater than 60°.

8. The spring structure as in any one of claims 2, 4, and 5, wherein the second contact-preventing end has a height of 5 to 40 mm.

9. The spring structure as in claim 3 or 4, wherein the third contact-preventing end has a height of 5 to 40 mm.

10. The spring structure as in claim 4 or 5, wherein the fourth contact-preventing end has a height of 5 to 40 mm.

11. The spring structure as in any one of claims 2, 4, and 5, wherein the inclination angle of the second contact-preventing end with respect to a vertical axis of the body spring is not greater than 60°.

12. The spring structure as in claim 3 or 4, wherein the inclination angle of the third contact-preventing end with respect to a vertical axis of the body spring is not greater than 60°.

13. The spring structure as in claim 4 or 5, wherein the inclination angle of the fourth contact-preventing end with respect to a vertical axis of the body spring is not greater than 60°.

* * * * *